US010750281B2

(12) United States Patent
Kang et al.

(10) Patent No.: US 10,750,281 B2
(45) Date of Patent: Aug. 18, 2020

(54) SOUND SOURCE SEPARATION APPARATUS AND SOUND SOURCE SEPARATION METHOD

(71) Applicant: SAMSUNG ELECTRONICS CO., LTD., Suwon-si (KR)

(72) Inventors: Sungchan Kang, Hwaseong-si (KR); Cheheung Kim, Yongin-si (KR); Yongseop Yoon, Seoul (KR); Choongho Rhee, Anyang-si (KR); Hyeokki Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/572,025

(22) Filed: Sep. 16, 2019

(65) Prior Publication Data

US 2020/0177992 A1 Jun. 4, 2020

(30) Foreign Application Priority Data

Dec. 3, 2018 (KR) ..... 10-2018-0153726

(51) Int. Cl.
*H04R 3/00* (2006.01)
*H04R 1/32* (2006.01)
(Continued)

(52) U.S. Cl.
CPC ..... *H04R 3/005* (2013.01); *G10L 21/028* (2013.01); *H04R 1/406* (2013.01); *H04R 2201/401* (2013.01)

(58) Field of Classification Search
CPC ... H04R 1/20; H04R 1/34; H04R 1/38; H04R 1/326; H04R 1/342; H04R 1/406;
(Continued)

(56) References Cited

U.S. PATENT DOCUMENTS 8,354,032 B2 1/2013 Dinger et al.
8,577,677 B2 11/2013 Kim et al.
(Continued)

FOREIGN PATENT DOCUMENTS

EP 1965603 A1 9/2008
EP 3279622 A1 2/2018
(Continued)

OTHER PUBLICATIONS

Communication dated Jan. 16, 2020, from the European Patent Office in counterpart European Application No. 19200842.3.

*Primary Examiner* — Thang V Tran
(74) *Attorney, Agent, or Firm* — Sughrue Mion, PLLC

(57) ABSTRACT

Provided are a sound source separation apparatus and a sound source separation method. The sound source separation apparatus includes a plurality of directional vibrators configured such that one or more of the plurality of directional vibrators react to a sound based on a direction of the sound. The sound source separation apparatus is configured to determine directions of a first sound source and a second sound source that are different from each other, based on strengths of output signals of the plurality of directional vibrators, and select a first directional vibrator and a second directional vibrator that are different from each other from among the plurality of directional vibrators to separately obtain a sound coming from the first sound source and a sound coming from the second sound source.

38 Claims, 18 Drawing Sheets

(51) Int. Cl.
*H04R 1/40* (2006.01)
*G10L 21/028* (2013.01)

(58) Field of Classification Search
CPC . H04R 3/00; H04R 3/05; H04R 17/00; H04R 17/02; H04R 17/025; H04R 17/08; H04R 2201/401; H04R 19/00; H04R 19/04; G10L 21/028; G10K 9/00; G10K 9/10; G10K 11/36; G10K 11/178; G10K 11/1781; G10K 13/00
See application file for complete search history.

(56) References Cited

U.S. PATENT DOCUMENTS

| | | | | |
|---|---|---|---|---|
| 8,718,293 | B2 | 5/2014 | Kim et al. | |
| 8,773,952 | B2 | 7/2014 | Shin | |
| 8,849,657 | B2 | 9/2014 | Shin | |
| 8,913,761 | B2 | 12/2014 | Shin | |
| 8,929,564 | B2 | 1/2015 | Kikkeri | |
| 9,066,170 | B2 | 6/2015 | Forutanpour et al. | |
| 9,943,940 | B2 | 4/2018 | Furusawa et al. | |
| 9,971,201 | B2 | 5/2018 | Shin et al. | |
| 10,148,247 | B2 | 12/2018 | Yasuda | |
| 2004/0105557 | A1* | 6/2004 | Matsuo | H04R 3/005 381/92 |
| 2011/0023099 | A1 | 1/2011 | Kim et al. | |
| 2012/0140948 | A1* | 6/2012 | Terada | H04R 29/006 381/92 |
| 2013/0035935 | A1 | 2/2013 | Kim et al. | |
| 2014/0084395 | A1* | 3/2014 | Sparks | G01L 9/008 257/416 |
| 2015/0281834 | A1* | 10/2015 | Takano | H04R 3/005 381/92 |
| 2016/0157011 | A1* | 6/2016 | Yoo | H04R 3/00 381/357 |
| 2017/0013355 | A1* | 1/2017 | Kim | H04R 19/005 |
| 2018/0199138 | A1 | 7/2018 | Dusan et al. | |
| 2018/0317002 | A1 | 11/2018 | Bernal Castillo et al. | |
| 2019/0072635 | A1* | 3/2019 | Kang | G10K 11/36 |
| 2019/0156837 | A1 | 5/2019 | Park et al. | |
| 2019/0174244 | A1 | 6/2019 | Kim et al. | |
| 2020/0068302 | A1* | 2/2020 | Kang | H04R 1/406 |

FOREIGN PATENT DOCUMENTS

| | | | | |
|---|---|---|---|---|
| JP | 2010057167 | A | * | 3/2010 |
| JP | 2017-71022 | A | | 4/2017 |
| KR | 10-2008-0071287 | A | | 8/2008 |
| KR | 10-2009-0104638 | A | | 10/2009 |
| KR | 10-2009-0104665 | A | | 10/2009 |
| KR | 10-2010-0007751 | A | | 1/2010 |
| KR | 10-2010-0010356 | A | | 2/2010 |
| KR | 10-2010-0127332 | A | | 12/2010 |
| KR | 10-2011-0047852 | A | | 5/2011 |
| KR | 10-2011-0047870 | A | | 5/2011 |
| KR | 10-2011-0076622 | A | | 7/2011 |
| KR | 10-2011-0088036 | A | | 8/2011 |
| KR | 10-2012-0066134 | A | | 6/2012 |
| KR | 10-2013-0014895 | A | | 2/2013 |
| KR | 10-2014-0046405 | A | | 4/2014 |
| KR | 10-1509342 | B1 | | 4/2015 |
| KR | 10-1520564 | B1 | | 5/2015 |
| KR | 10-2015-0140500 | A | | 12/2015 |
| KR | 10-2017-0000783 | A | | 1/2017 |
| KR | 10-2017-0041328 | A | | 4/2017 |
| KR | 10-2018-0079975 | A | | 7/2018 |
| KR | 10-2019-0060028 | A | | 6/2019 |
| KR | 10-2019-0067289 | A | | 6/2019 |
| WO | 2010051509 | A1 | | 5/2010 |

* cited by examiner

SOUND SOURCE SEPARATION APPARATUS AND SOUND SOURCE SEPARATION METHOD

CROSS-REFERENCE TO RELATED APPLICATION

This application is based on and claims priority from Korean Patent Application No. 10-2018-0153726, filed on Dec. 3, 2018, in the Korean Intellectual Property Office, the disclosure of which is incorporated herein in its entirety by reference.

BACKGROUND

1. Field

Disclosed embodiments relate to a sound source separation apparatus and a sound source separation method, and more particularly, to a sound source separation apparatus and a sound source separation method in which sounds coming from two sound sources may be separated by using a plurality of directional vibrators.

2. Description of the Related Art

Recently, sound direction detection and voice recognition using sensors mounted in home appliances, image display apparatuses, virtual reality apparatuses, augmented reality apparatuses, artificial intelligence speakers, etc., is increasing. In particular, the use of an acoustic sensor for separately identifying sounds coming from sound sources located in two different directions is also increasing.

Related art sound source separation methods include, for example, independent component analysis (ICA), geometric source separation (GSS), and so forth. ICA or GSS involves estimating a location by analyzing a signal input to multiple microphones through time-frequency domain conversion and extracting characteristics of a sound source for separation. Recently, a method has also been developed in which after multiple sound sources are trained using a deep neural network technology, a sound source is separated based on a learning result.

SUMMARY

According to an aspect of the disclosure, there is provided a sound source separation apparatus comprising: a sound inlet configured to receive a sound; a sound outlet configured to output the sound received through the sound inlet; a plurality of directional vibrators arranged on a plane between the sound inlet and the sound outlet, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet; and a control circuit configured to: determine a first direction of a first sound source and a second direction of a second sound source that is different from the first sound source, based on strengths of output signals of the plurality of directional vibrators, and select a first directional vibrator and a second directional vibrator from among the plurality of directional vibrators to separately obtain a first sound from the first sound source and a second sound from the second sound source, wherein the first directional vibrator is different from the second directional vibrator.

The control circuit may be further configured to obtain first information about the first sound from the first sound source based on a first output signal of the first directional vibrator and second information about the second sound from the second sound source based on a second output signal of the second directional vibrator.

The control circuit may be configured to select a directional vibrator having a highest sensitivity to the first direction of the first sound source, among the plurality of directional vibrators, as the first directional vibrator and select a directional vibrator having a highest sensitivity to the second direction of the second sound source, among the plurality of directional vibrators, as the second directional vibrator.

The control circuit may be further configured to select a directional vibrator arranged in the first direction of the first sound source, among the plurality of directional vibrators, as the first directional vibrator and select a directional vibrator arranged in the second direction of the second sound source, among the plurality of directional vibrators, as the second directional vibrator.

The control circuit may be further configured to obtain the first information about the first sound from the first sound source and the second information about the second sound from the second sound source by computing a first output signal and a second output signal based on a first rate of the second sound of the second sound source contributing to the first output signal of the first directional vibrator and a second rate of the first sound of the first sound source contributing to the second signal of the second directional vibrator.

In a case that the first output signal of the first directional vibrator is $C1$, the second output signal of the second directional vibrator is $C2$, a first sound signal of the first sound source is $S1$, a second sound signal of the second sound source is $S2$, the first rate of the second sound of the second sound source contributing to the first output signal of the first directional vibrator is $\alpha$, and the second rate of the first sound of the first sound source contributing to the second output signal of the second directional vibrator is $\beta$, then $C1=S1+\alpha S2$ and $C2=S2+\beta S1$, and $S1=(C1-\alpha C2)/(1-\alpha\beta)$ and $S2=(C2-\beta C1)/(1-\alpha\beta)$.

The first rate of the second sound of the second sound source contributing to the first output signal of the first directional vibrator may be determined by a first angle between the first directional vibrator and the second sound source, and the second rate of the first sound of the first sound source contributing to the second output signal of the second directional vibrator may be determined by a second angle between the second directional vibrator and the first sound source.

The sound source separation apparatus may comprise a memory configured to store sensitivity information of each directional vibrator with respect to a direction of a sound incident to each directional vibrator.

The control circuit may be further configured to select a directional vibrator having a lowest sensitivity to the second direction of the second sound source, among a plurality of directional vibrators arranged in a first angle range around the first direction of the first sound source, as the first directional vibrator and select a directional vibrator having a lowest sensitivity to the first direction of the first sound source, among the plurality of directional vibrators arranged in a second angle range around the second direction of the second sound source, as the second directional vibrator.

The control circuit may be further configured to determine the second direction of the second sound source during a first time in which the first sound from the first sound source decreases and determine the first direction of the first sound source during a second time in which the second sound from the second sound source decreases.

The control circuit may be further configured to determine that there are two or more sound sources in a case that strengths of output signals of a plurality of directional vibrators arranged in a range of 180 degrees have two or more peaks, and determine a direction of a sound source during a time in which the strengths of the output signals of the plurality of directional vibrators arranged in the range of 180 degrees have one peak.

The control circuit may be further configured to determine an arrangement direction of a directional vibrator having a highest strength of an output signal, among the plurality of directional vibrators, as the first direction of the first sound source or the second direction of the second sound source.

The control circuit may be further configured to determine a direction perpendicular to an arrangement direction of a directional vibrator having a lowest strength of an output signal, among the plurality of directional vibrators, as the first direction of the first sound source or the second direction of the second sound source.

The control circuit may be further configured to compare a vibration strength of a directional vibrator arranged at +90° with respect to a directional vibrator having a lowest strength of an output signal with a vibration strength of a directional vibrator arranged at −90° with respect to the directional vibrator having the lowest strength of the output signal, and determine an arrangement direction of a directional vibrator having a higher strength of the output signal, among the directional vibrator arranged at +90° and the directional vibrator arranged at −90°, as the first direction of the first sound source or the second direction of the second sound source.

The sound source separation apparatus may further comprise an omnidirectional vibrator configured to react to an input sound regardless of a direction of the input sound.

The control circuit may be further configured to compare a phase of a directional vibrator arranged at +90° with respect to a directional vibrator having a lowest strength of an output signal with a phase of the omnidirectional vibrator, compare a phase of a directional vibrator arranged at −90° with respect to the directional vibrator having the lowest strength of the output signal with the phase of the omnidirectional vibrator, and determine an arrangement direction of a directional vibrator, among the directional vibrator arranged at +90° and the directional vibrator arranged at −90°, having a phase closest to the phase of the omnidirectional vibrator as the direction of the first sound source or the second sound source.

The plurality of directional vibrators and the omnidirectional vibrator may be arranged on an identical plane, and the plurality of directional vibrators may be arranged to surround the omnidirectional vibrator.

The plurality of directional vibrators may be arranged to have symmetry with respect to the center point.

The sound outlet may be provided to face all the plurality of directional vibrators.

The sound outlet may comprise a plurality of sound outlets respectively facing the plurality of directional vibrators.

The plurality of directional vibrators may have an identical resonant frequency.

The plurality of directional vibrators may comprise a plurality of directional vibrators having different resonant frequencies.

According to another aspect of the disclosure, there is provided a sound source separation method comprising: receiving a sound through a sound inlet of a sound source separation apparatus; outputting the sound received through the sound inlet by a sound outlet; determining a first direction of a first sound source and a second direction of a second sound source that is different from the first sound source, based on strengths of output signals of a plurality of directional vibrators arranged on a plane between the sound inlet and the sound outlet, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet; selecting a first directional vibrator and a second directional vibrator from among the plurality of directional vibrators to separately obtain a first sound from the first sound source and a second sound from the second sound source; and obtaining sound information by using the first directional vibrator and the second directional vibrator, wherein the first directional vibrator is different from the second directional vibrator.

The determining of the first direction of the first sound source and the second direction of the second sound source may comprise: determining the second direction of the second sound source during a first time in which the first sound from the first sound source decreases; and determining the second direction of the first sound source during a second time in which the second sound coming from the second sound source decreases.

The determining of the first direction of the first sound source and the second direction of the second sound source may comprise: determining that there are two or more sound sources in a case that strengths of output signals of a plurality of directional vibrators arranged in a range of 180 degrees have two or more peaks; and determining a direction of a sound source during a time in which the strengths of the output signals of the plurality of directional vibrators arranged in the range of 180 degrees have one peak.

The determining of the first direction of the first sound source and the second direction of the second sound source may comprise determining an arrangement direction of a directional vibrator having a highest strength of an output signal, among the plurality of directional vibrators, as the first direction of the first sound source or the second direction of the second sound source.

The determining of the first direction of the first sound source and the second direction of the second sound source may comprise determining a direction perpendicular to an arrangement direction of a directional vibrator having a lowest strength of an output signal, among the plurality of directional vibrators, as the first direction of the first sound source or the second direction of the second sound source.

The determining of the first direction of the first sound source and the second direction of the second sound source may comprise: comparing a vibration strength of a directional vibrator arranged at +90° with respect to a directional vibrator having a lowest strength of an output signal with a vibration strength of a directional vibrator arranged at −90° with respect to the directional vibrator having the lowest strength of the output signal; and determining an arrangement direction of a directional vibrator having a higher strength of the output signal, among the directional vibrator arranged at +90° and the directional vibrator arranged at −90°, as the direction of the first sound source or the second sound source.

The sound source separation method may further comprise receiving an input sound by using an omnidirectional vibrator reacting to the sound regardless of a direction of the input sound.

The determining of the first direction of the first sound source and the second direction of the second sound source may comprise: comparing a phase of a directional vibrator arranged at +90° with respect to a directional vibrator having a lowest strength of an output signal with a phase of the omnidirectional vibrator; comparing a phase of a directional vibrator arranged at −90° with respect to the directional vibrator having the lowest strength of the output signal with a phase of the omnidirectional vibrator; and determining an arrangement direction of a directional vibrator having a phase closest to the phase of the omnidirectional vibrator, among the directional vibrator arranged at +90° and the directional vibrator arranged at −90°, as the first direction of the first sound source or the second direction of the second sound source.

The obtaining of the sound information by using the first directional vibrator and the second directional vibrator may comprise: obtaining first information about the first sound from the first sound source based on a first output signal of the first directional vibrator; and obtaining second information about the second sound from the second sound source based on a second output signal of the second directional vibrator.

The selecting of the first directional vibrator and the second directional vibrator may comprise: selecting a directional vibrator having a highest sensitivity to the first direction of the first sound source, among the plurality of directional vibrators, as the first directional vibrator; and selecting a directional vibrator having a highest sensitivity to the second direction of the second sound source, among the plurality of directional vibrators, as the second directional vibrator.

The selecting of the first directional vibrator and the second directional vibrator may comprise: selecting a directional vibrator arranged in the direction of the first sound source, among the plurality of directional vibrators, as the first directional vibrator; and selecting a directional vibrator arranged in the direction of the second sound source, among the plurality of directional vibrators, as the second directional vibrator.

The obtaining of the sound information by using the first directional vibrator and the second directional vibrator may comprise: determining a first rate of the second sound of the second sound source contributing to the first output signal of the first directional vibrator and a second rate of the first sound of the first sound source contributing to the second output signal of the second directional vibrator; and obtaining the first information about the first sound from the first sound source and the second information about the sound from the second sound source by computing the first output signal and the second output signal based on the first rate of the second sound of the second sound source contributing to the first output signal of the first directional vibrator and the second rate of the first sound of the first sound source contributing to the second signal of the second directional vibrator.

In a case that the first output signal of the first directional vibrator is C1, the second output signal of the second directional vibrator is C2, a first sound signal of the first sound source is S1, a second sound signal of the second sound source is S2, the first rate of the second sound of the second sound source contributing to the first output signal of the first directional vibrator is $\alpha$, and the second rate of the first sound of the first sound source contributing to the second output signal of the second directional vibrator is $\beta$, then $C1=S1+\alpha S2$ and $C2=S2+\beta S1$, and $S1=(C1-\alpha C2)/(1-\alpha\beta)$ and $S2=(C2-\beta C1)/(1-\alpha\beta)$.

The first rate of the second sound of the second sound source contributing to the first output signal of the first directional vibrator may be determined by a first angle between the first directional vibrator and the second sound source, and the second rate of the first sound of the first sound source contributing to the second output signal of the second directional vibrator is determined by a second angle between the second directional vibrator and the first sound source.

The selecting of the first directional vibrator and the second directional vibrator may comprise: selecting a directional vibrator having a lowest sensitivity to the second direction of the second sound source, among a plurality of directional vibrators arranged in a first angle range around the first direction of the first sound source, as the first directional vibrator; and selecting a directional vibrator having a lowest sensitivity to the first direction of the first sound source, among the plurality of directional vibrators arranged in a second angle range around the second direction of the second sound source, as the second directional vibrator.

According to another aspect of the disclosure, there is provided a sound source separation apparatus comprising: a case having a first opening and one or more second openings, the first opening configured to receive a sound and the one or more second openings configured to output the sound received through the first opening. a support member provided on an inside surface of the case and having a hole in a center portion; a plurality of directional vibrators arranged on the support member to surround a center point in the hole of the support member corresponding to a central axis of the first opening, the plurality of directional vibrators are arranged in such a manner that one or more of the plurality of directional vibrators is configured to selectively react based on a direction of the sound received through that is input to the first opening.

Each of the plurality of directional vibrators may comprise: a movable portion configured to move based on the sound, and a sensing portion configured to detect a movement of the movable portion.

Each of the plurality of directional vibrators may further comprise a mass body formed on the movable portion according to a resonance frequency.

According to another aspect of the disclosure, there is provided a sound source separation apparatus comprising: a memory configured to store one or more instructions; and a processor configured to execute the one or more instructions to: determine a first direction of a first sound source and a second direction of a second sound source that is different from the first sound source, based on strengths of output signals received from a plurality of directional vibrators arranged on a plane between a sound inlet and a sound outlet of the sound source separation apparatus, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet; select a first directional vibrator and a second directional vibrator from among the plurality of directional vibrators to separately obtain a first sound from the first sound source and a second sound from the second sound source; and obtain sound information by using the first directional vibrator and the second directional vibrator, wherein the first directional vibrator is different from the second directional vibrator.

BRIEF DESCRIPTION OF THE DRAWINGS

These and/or other aspects will become apparent and more readily appreciated from the following description of the embodiments of the disclosure, taken in conjunction with the accompanying drawings in which.

DETAILED DESCRIPTION

Figure 1:
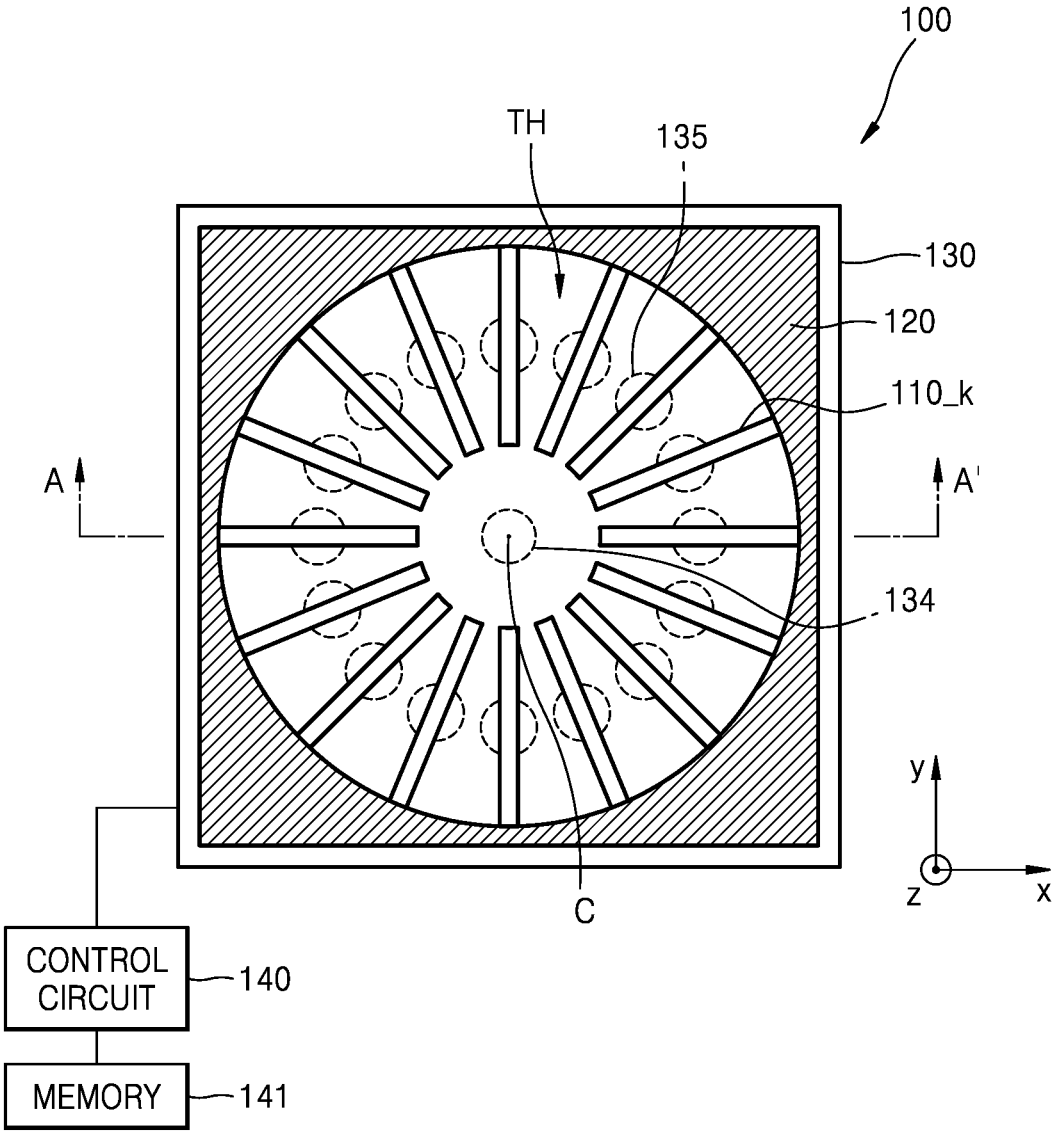
FIG. 1 is a plan view illustrating a schematic structure of a sound source separation apparatus according to an embodiment of the disclosure.

Reference will now be made in detail to embodiments of the disclosure, examples of which are illustrated in the accompanying drawings, wherein like reference numerals refer to like elements throughout. In this regard, the embodiments of the disclosure may have different forms and should not be construed as being limited to the descriptions set forth herein. Accordingly, the embodiments of the disclosure are merely described below, by referring to the figures, to explain aspects. It will be understood that when a layer is referred to as being "on" another layer or substrate, it can be directly on the other layer or substrate, or intervening layers may also be present. Expressions such as "at least one of," when preceding a list of elements, modify the entire list of elements and do not modify the individual elements of the list.

Figure 2:
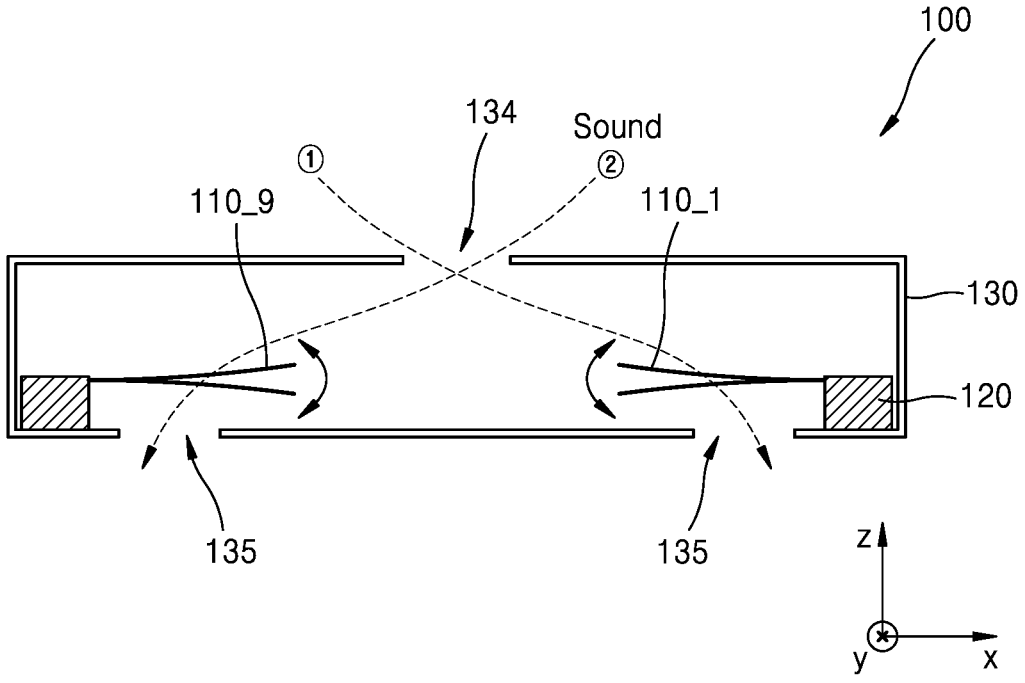
FIG. 2 is a cross-sectional view taken along line A-A' of the sound source separation apparatus illustrated in FIG. 1.

FIG. 1 is a plan view illustrating a schematic structure of a sound source separation apparatus according to an embodiment of the disclosure. FIG. 2 is a cross-sectional view taken along line A-A' of the sound source separation apparatus illustrated in FIG. 1. Referring to FIGS. 1 and 2, a sound source separation apparatus 100 according to an embodiment of the disclosure may include a sound inlet 134 receiving input sound, sound outlets 135 outputting the input sound received through the sound inlet 134, and a plurality of directional vibrators 110_*k* arranged between the sound inlet 134 and the sound outlets 135. Herein, assuming that the number of directional vibrators 110_*k* is N, k is an integer from 1 to N.

According to an embodiment, a physical angular resolution of the sound source separation apparatus 100 may be determined based on the number N of directional vibrators 110_*k*. For example, the physical angular resolution of the sound source separation apparatus 100 may be expressed as 360°/N. The sound source separation apparatus 100 may detect an input direction of the sound by comparing strengths of output signals of the plurality of directional vibrators 110_*k*, and a higher angular resolution may be achieved when a larger number of directional vibrators 110_*k* to be compared in strengths of output signals are used. The plurality of directional vibrators 110_*k* are arranged in such a manner that at least one directional vibrator 110_*k* selectively reacts based on a direction of the sound input through the sound inlet 134. The plurality of directional vibrators 110_*k* may be arranged to surround the sound inlet 134. The plurality of directional vibrators 110_*k* may be arranged on a plane not to overlap each other and all the plurality of directional vibrators 110_*k* may be exposed by the sound inlet 134. As illustrated in FIG. 1, the plurality of directional vibrators 110_*k* may be arranged on the same plane. In addition, the plurality of directional vibrators 110_*k* may be arranged to surround a center point C on the plane that is perpendicular to a central axis of the sound inlet 134. The plurality of directional vibrators 110_*k* surround the center point C in a circular shape in FIG. 1, but the above description is merely an example. The plurality of directional vibrators 110_*k* are not limited to the above-described arrangement and may also be arranged in various shapes having symmetry with respect to the center point C. For example, the plurality of directional vibrators 110_*k* may be arranged in a polygonal or oval shape. According to an embodiment, the plurality of directional vibrators 110_*k* may be arranged on different planes to provide a different configuration according to the frequency characteristics of the sound to be detected.

The number of sound outlets 135 may equal the number of directional vibrators 110_*k* and may respectively face the plurality of directional vibrators 110_*k*. The sound inlet 134 and the sound outlets 135 are not limited to any particular size or shape and may also have arbitrary sizes and shapes capable of equally exposing the plurality of directional vibrators 110_*k*.

According to an embodiment, a case 130 having openings corresponding to the shapes of the sound inlet 134 and the sound outlets 135 may be used as the sound inlet 134 and the sound outlets 135. The case 130 may be made of various materials capable of blocking sound. For example, the case 130 may be made of a material such as aluminum. The sound inlet 134 and the sound outlets 135 provided in the case 130 are not limited to the shapes illustrated in FIG. 1.

According to an embodiment, a support 120 configured to support the plurality of directional vibrators 110_*k* may be provided inside the case 130. Also, the support 120 may provide a space in which the plurality of directional vibrators 110_*k* vibrate in reaction to sound may be located. According to an embodiment, the support 120 may be provided by forming a hole in a substrate. As illustrated in FIG. 1, the hole may be a through hole TH in the substrate. The plurality of directional vibrators 110_*k* may be supported by the support 120 at ends thereof and be located to face the through hole TH. The through hole TH provides a space in which the directional vibrators 110_*k* vibrate due to an external force and is not limited to any particular shape or size as long as the through hole TH provides such a space. The support 120 may be made of various materials such as a silicon substrate.

The sound source separation apparatus 100 may further include a control circuit 140 that detects directions of two or more sound sources located in different positions in an azimuthal direction by comparing strengths of output signals of the plurality of directional vibrators 110_*k* and selects the directional vibrator 110_*k* that is to obtain sound information based on the detected directions of the sound sources. The sound source separation apparatus 100 may further include a memory 141 that stores data such as sensitivity of each directional vibrator 110_*k* corresponding to a sound incident direction.

Figure 3A:
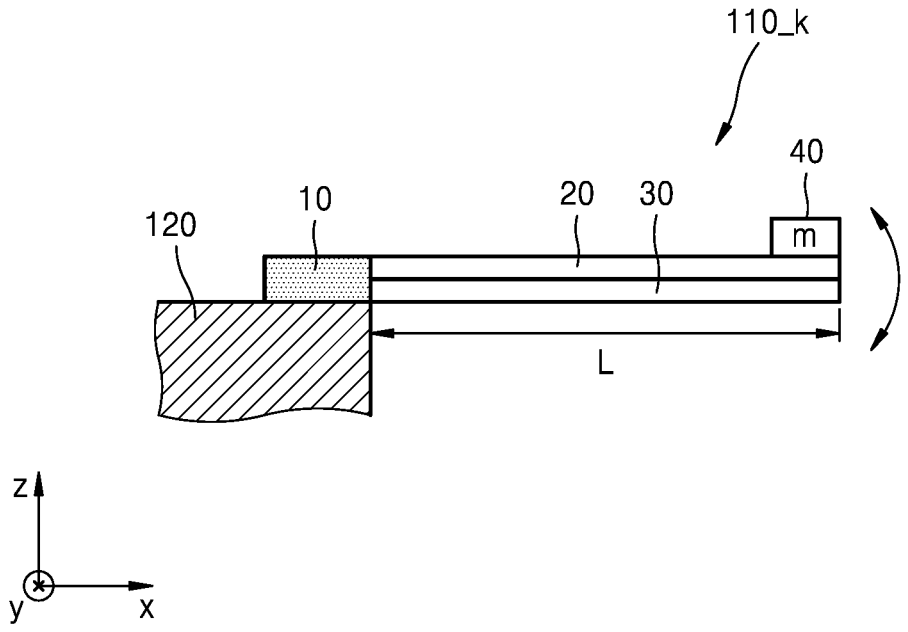
FIG. 3A is a cross-sectional view illustrating in detail a structure of one of a plurality of directional vibrators included in the sound source separation apparatus illustrated in FIG. 1.
Figure 3B:
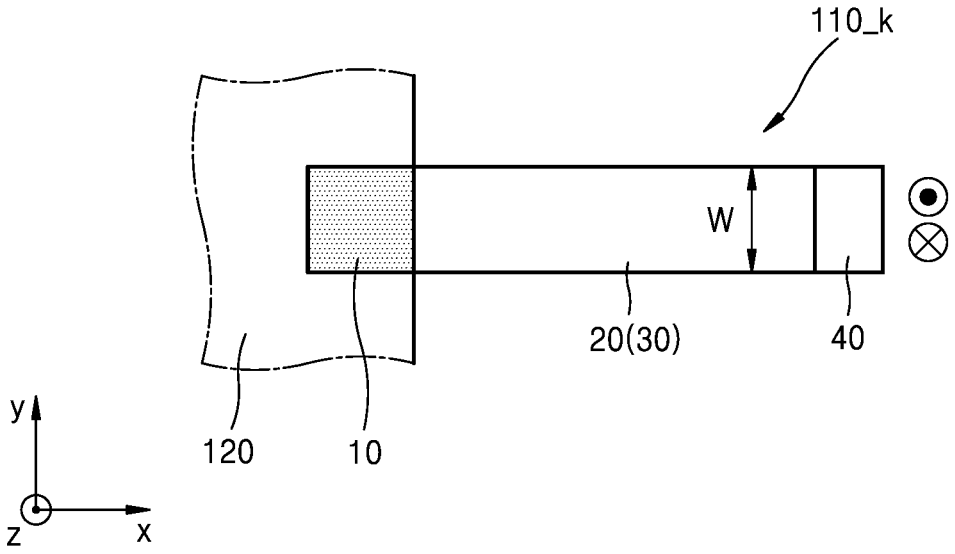
FIG. 3B is a plan view illustrating in detail a structure of one of a plurality of directional vibrators included in the sound source separation apparatus illustrated in FIG. 1.

FIG. 3A is a cross-sectional view of one of the plurality of directional vibrators 110_*k* included in the sound source separation apparatus 100 of FIG. 1, and FIG. 3B is a plan view of one of the plurality of directional vibrators 110_*k* included in the sound source separation apparatus 100 of FIG. 1. Referring to FIGS. 3A and 3B, the directional vibrator 110_*k* may include a fixed portion 10 fixed to the support 120, a movable portion 30 movable in reaction to a sound signal, and a sensing portion 20 configured to detect motion of the movable portion 30. The directional vibrator 110_*k* may further include a mass body 40 configured to provide a certain mass m to the movable portion 30.

The movable portion 30 may be made of, for example, an elastic film. The elastic film may have a length L and a width W and determine resonance characteristics of the directional vibrator 110_*k* together with the mass m of the mass body 40. The elastic film may be made of a material such as silicon, metal, or polymer. According to an embodiment, the resonance frequency of the directional vibrator 110_*k* may be changed using different weight for the mass body 40 and/or by changing the length of the directional vibrator 110_*k*.

The sensing portion 20 may include a sensor layer configured to detect motion of the movable portion 30. The sensing portion 20 may include, for example, a piezoelectric element. In this case, the sensing portion 20 may have a structure in which an electrode layer, a piezoelectric material layer, and another electrode layer are stacked on one another. The piezoelectric material may include, for example, zinc oxide (ZnO), tin oxide (SnO), lead zirconate titanate (PZT), zinc stannate ($ZnSnO_3$), polyvinylidene fluoride (PVDF), poly(vinylidene fluoride-trifluoroethylene) P(VDF-TrFE), aluminum nitride (AlN), or lead magnesium niobate-lead titanate (PMN-PT). The electrode layer may be made of a metal material or various other conductive materials.

Values of the width, thickness, etc. of the directional vibrators 110_*k* may be determined considering a resonant frequency desired for the directional vibrators 110_*k*. For example, each directional vibrator 110_*k* may have a width between about several μm to several hundred μm, a thickness equal to or less than several μm, and a length equal to or less than about several mm, but is not limited thereto. The micro-sized directional vibrators 110_*k* may be produced using a microelectromechanical system (MEMS) process.

The directional vibrator 110_*k* vertically vibrates in a Z-direction in reaction to an external sound signal and has an output proportional to a displacement z. The displacement z satisfies the following equation of motion.

$$m\frac{d^2z}{dt^2} + c\frac{dz}{dt} + kz = F_0\cos\omega t$$

In the above equation, c denotes a damping coefficient and k denotes an elastic coefficient. $F_0 \cos \omega t$ denotes a driving force and indicates an action by a sound signal input to the directional vibrator 110_*k*. The value of k is determined based on physical properties and the shape of the movable portion 30.

The directional vibrator 110_*k* shows frequency response characteristics of a certain bandwidth with respect to a resonant frequency $f_0$ as a center frequency. The center frequency $f_0$ is defined below.

$$f_0 = \frac{1}{2\pi}\sqrt{\frac{k}{m}}$$

As such, the directional vibrators 110_*k* included in the sound source separation apparatus 100 may detect sound having a certain frequency band with respect to a designed center frequency. Therefore, when the center frequency is designed, a frequency band having high availability in a given environment may be selected and the directional vibrators 110_*k* may be implemented in accordance with the selected frequency band.

In the sound source separation apparatus 100 according to an embodiment of the disclosure, the directional vibrators 110_*k* located in different positions may be set to the same length to have the same resonant frequency. However, the plurality of directional vibrators 110_*k* are not limited thereto and may be modified to have different resonant frequencies.

Figure 4:
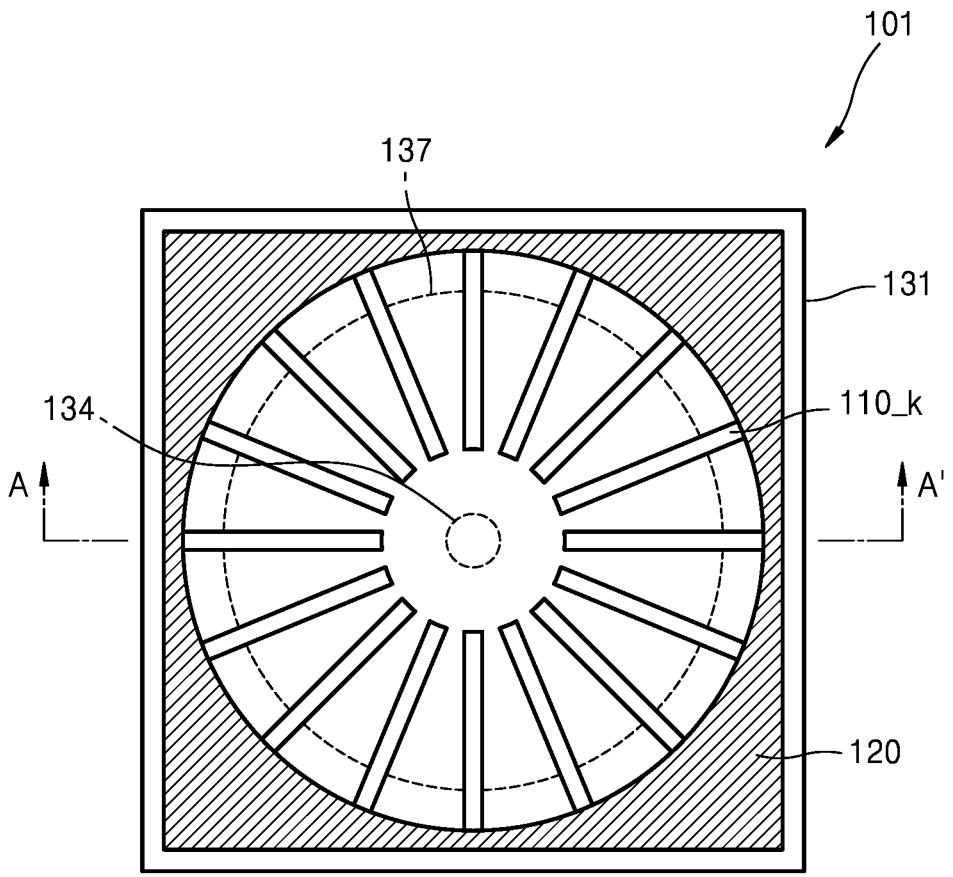
FIG. 4 is a plan view illustrating a schematic structure of a sound source separation apparatus according to another embodiment of the disclosure.
Figure 5:
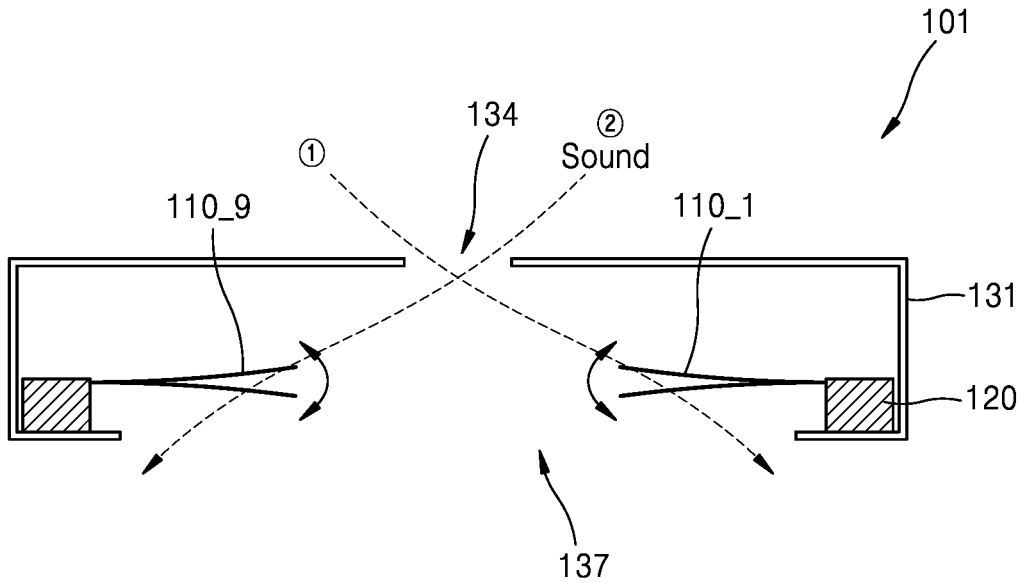
FIG. 5 is a cross-sectional view taken along line A-A' of the sound source separation apparatus illustrated in FIG. 4.

FIG. 4 is a plan view of a sound source separation apparatus according to another embodiment of the disclosure. FIG. 5 is a cross-sectional view taken along line A-A' of the sound source separation apparatus of FIG. 4. Referring to FIGS. 4 and 5, a sound source separation apparatus 101 may include the sound inlet 134 receiving input sound, a sound outlet 137 outputting the sound input through the sound inlet 134, and the plurality of directional vibrators 110_*k* arranged between the sound inlet 134 and the sound outlet 137. Herein, assuming that the number of directional vibrators 110_*k* is N, k is an integer from 1 to N.

The elements of the sound source separation apparatus 101 of FIGS. 4 and 5 are the same as those of the sound source separation apparatus 100 of FIGS. 1 and 2 except for the shape of the sound outlet 137. For example, the sound outlet 137 is not provided in a plural number corresponding to the number of directional vibrators 110_*k*, and a single sound outlet 137 is shared by the plurality of directional vibrators 110_*k*. In other words, the single sound outlet 137 may face all the plurality of directional vibrators 110_*k*. The size of the sound outlet 137 illustrated in FIGS. 4 and 5 is an example and may be smaller than the illustrated size.

A case 131 having openings corresponding to the shapes of the sound inlet 134 and the sound outlets 137 may be used for the sound inlet 134 and the sound outlet 137. The size of the sound outlet 137 may not be specified. For example, an entire space opposite to the sound inlet 134 with respect to the plurality of directional vibrators 110_*k* may be open. The open space may serve as the sound outlet 137.

According to the afore-described embodiments of the disclosure, in the sound source separation apparatuses 100 and 101, one or more of the plurality of directional vibrators 110_*k*, which are placed on input paths of directional sound, vibrate in reaction to the sound. For example, as illustrated in FIG. 2, when the sound is input along path ①, a first directional vibrator 110_1 located on this path and one or more directional vibrators adjacent thereto may vibrate. Otherwise, when the sound is input along path ②, a ninth directional vibrator 110_9 placed on this path and one or more directional vibrators adjacent thereto may vibrate. Therefore, an input direction of the sound may be detected considering outputs of the plurality of directional vibrators 110_*k* based on the direction of the input sound.

According to an embodiment, the displacement of the directional vibrators may be based on a relationship between the size of the sound inlet 134 and the size of the sound outlet 135. For instance, the displacement of the directional vibrator 110_9 (i.e., at 180° from the direction of the sound input) may be larger than the displacement of the directional vibrator 110_1 in reaction to the sound input from the direction of 0°, when the sound outlet 135 is larger than the sound inlet 134. According to another embodiment, if the size of sound inlet 134 is same as the size of the sound outlet 135, the output generated in reaction to the sound input from the direction of 0° (i.e., directional vibrator 110_1) and 180° (i.e., directional vibrator 110_9) may be the same.

Figure 6:
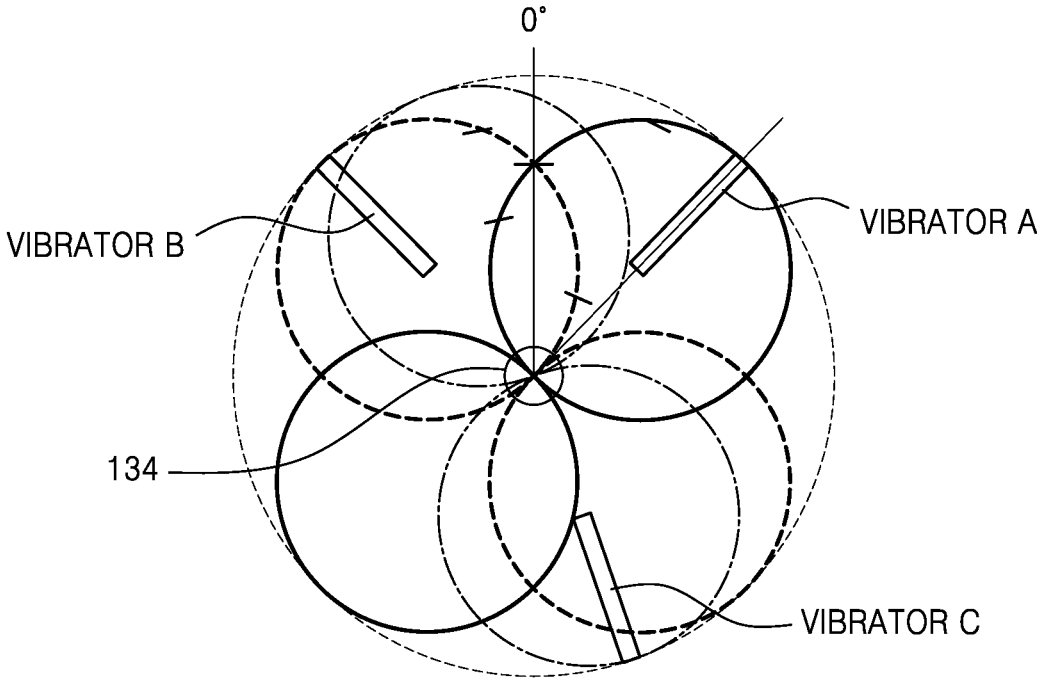
FIG. 6 is a plan view of some of a plurality of directional vibrators for describing an operation principle and directional gain characteristics of the plurality of directional vibrators.

FIG. 6 is a plan view of some of the plurality of directional vibrators 110_*k* for describing an operation principle and directional gain characteristics of the plurality of directional vibrators 110_*k*. Referring to FIG. 6, a plurality of directional vibrators A, B, and C serve as unit acoustic sensors having directional angles corresponding to radius directions of a circle around the sound inlet 134. A directional gain curve of each unit acoustic sensor has a figure of eight. Due to the directional gain curves, the sound source separation apparatus 100 or 101 has an output in which outputs of the directional vibrators 110_*k* selectively reacting to signals input from all directions are superposed.

Each directional vibrator 110_*k* has a preferred angle, which is a principal direction, according to a position where the directional vibrator 110_*k* is arranged. The contribution of the sound from a principal direction is more the contribution of the sound from the other directions. Therefore, an input direction of sound from all arbitrary directions may be estimated by merely comparing magnitudes of outputs of the plurality of directional vibrators 110_*k*.

Figure 7:
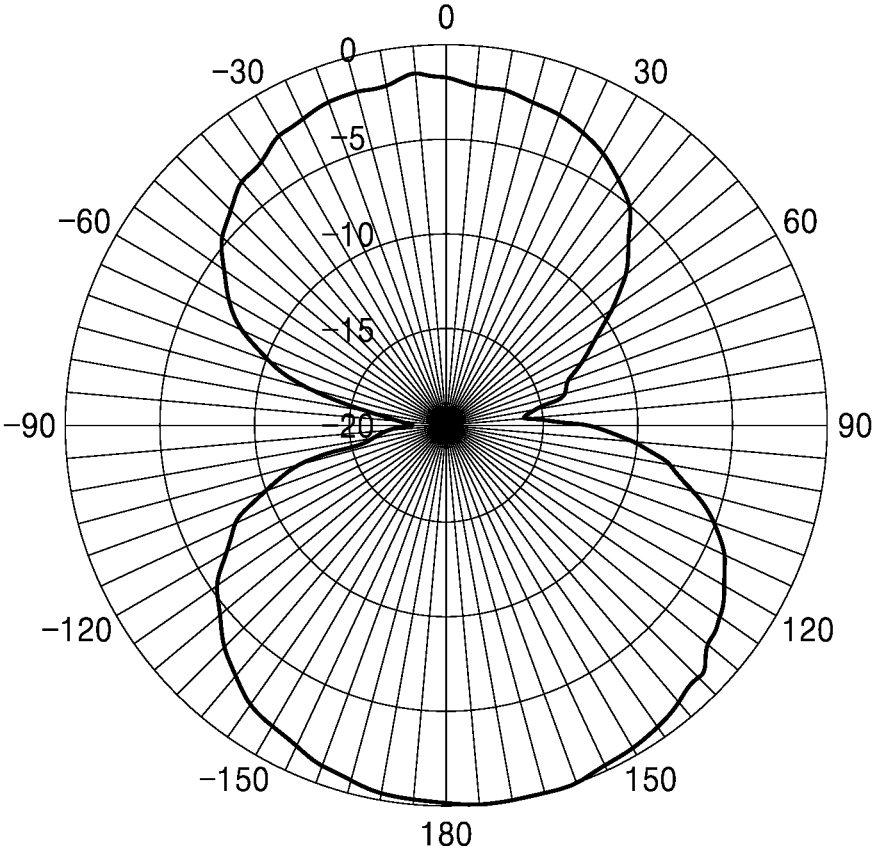
FIG. 7 is a graph showing an example of directional characteristics of one of the plurality of directional vibrators.

FIG. 7 is a graph showing an example of directional characteristics of one of the plurality of directional vibrators 110_*k*. In FIG. 7, it is assumed that sixty-four directional vibrators 110_*k* are arranged on a single plane in a circular shape and are aligned toward a center point C on the plane that is perpendicular to a central axis of the sound inlet 134. However, the number of directional vibrators 110_*k* is not limited to 64, and in practice, 64 or more directional vibrators 110_*k* may be used. Referring to FIG. 7, a directional vibrator located in a direction of 180° has the highest outputs in reaction to sound input from directions of 180° and 0° and has the lowest outputs in reaction to sound input from directions of −90° and +90°, thereby exhibiting figure-of-eight gain characteristics. In particular, the output generated in reaction to the sound input from the direction of 180° is slightly higher than the output generated in reaction to the sound input from the direction of 0°.

Figure 8:
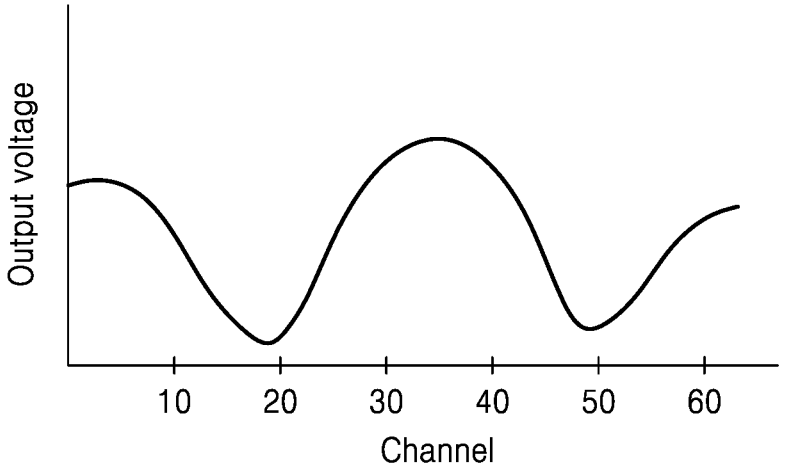
FIG. 8 is a graph showing outputs of all directional vibrators included in the sound source separation apparatus in a case when sound is input from one direction.

FIG. 8 is a graph showing outputs of all directional vibrators 110_*k* included in the sound source separation apparatus 100 or 101 in a case when sound is input from one direction. In FIG. 8, it is assumed that 64 directional vibrators 110_*k* are arranged, first through sixty fourth directional vibrators are arranged in a clockwise direction from the direction of 0°, and a sound is incident toward a thirty-third directional vibrator in a longitudinal direction of the thirty third directional vibrator located in the direction of 180°. Referring to FIG. 8, the peak outputs are shown near the first directional vibrator and near a thirty-third directional vibrator located opposite to the first directional vibrator. In addition, the lowest outputs are shown near a seventeenth directional vibrator located in a direction of +90° from the first directional vibrator and near a forty ninth directional vibrator located in a direction of −90° from the first directional vibrator. In particular, the output is the highest near the thirty-third directional vibrator.

Consequently, among the plurality of directional vibrators 110_*k*, a directional vibrator located in a direction of the input sound has the highest output and a directional vibrator located in a direction of ±90° from the direction of the input sound has the lowest output. Thus, the control circuit 140 of the sound source separation apparatus 100 or 101 may determine a direction of an input sound, i.e., a direction of a sound source by using the directional vibrator having the highest output or the directional vibrator using the lowest output.

For example, the control circuit 140 may determine as a direction of a sound source, an arrangement direction of a directional vibrator having the highest strength of an output signal among the plurality of directional vibrators 110_*k*. Alternately, the control circuit 140 may determine as the direction of the sound source, a direction perpendicular to an arrangement direction of a directional vibrator having the lowest strength of an output signal among the plurality of directional vibrators 110_*k*. In particular, the control circuit 140 may compare a vibration strength of a directional vibrator arranged at +90° with respect to the directional vibrator having the lowest output signal strength with a strength of an output signal of a directional vibrator arranged at −90° with respect to the directional vibrator having the lowest output signal strength, and determine an arrangement direction of the directional vibrator having the higher output signal strength as the direction of the sound source.

In the case that sounds are simultaneously incident from two sound sources located in different positions in the azimuthal direction, directions of the two sound sources may be known by using a point in which outputs of the two sound sources differ with time. For example, during a period in which an output of a first sound source decreases and an output of a second sound source increases, a direction of the second sound source may be determined using the above-described method. During a period in which the output of the first sound source increases and the output of the second sound source decreases, the direction of the first sound source may be determined using the above-described method.

Figure 9:
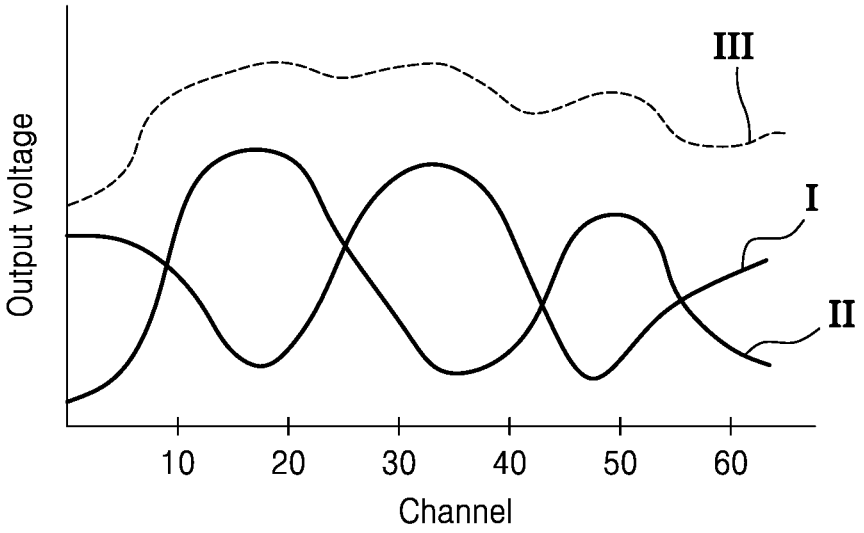
FIG. 9 is a graph showing outputs of all directional vibrators included in the sound source separation apparatus in a case when sound is input from two different directions.

For example, FIG. 9 is a graph showing outputs of all directional vibrators 110_*k* included in the sound source separation apparatus 100 or 101 in a case when sounds are input from two different directions. In FIG. 9, it is assumed that 64 directional vibrators 110_*k* are arranged and the first through sixty fourth directional vibrators are arranged in the clockwise direction from the direction of 0°. It is also assumed that a sound is incident from the first sound source toward the thirty third directional vibrator in the longitudinal direction of the thirty third directional vibrator located in the direction of 180°, and at the same time, another sound is incident from the second sound source toward the seventeenth directional vibrator in the longitudinal direction of the seventeenth directional vibrator located in the direction of 90°. In other words, it is assumed that the first sound source is located in the direction of 180° and the second sound source is located in the direction of 90°.

Referring to FIG. 9, in a graph I showing outputs of the directional vibrators 110_*k* by the first sound source, the peak outputs are shown near the first directional vibrator and near the thirty-third directional vibrator located opposite to the first directional vibrator, respectively, and the lowest outputs are shown near the seventeenth directional vibrator and the fourth ninth directional vibrator, respectively. In a graph II showing outputs of the directional vibrators 110_*k* by the second sound source, the peak outputs are shown near the seventeenth directional vibrator and near the forty ninth directional vibrator located opposite to the seventeenth directional vibrator, respectively, and the lowest outputs are shown near the first directional vibrator and the thirty third directional vibrator, respectively.

Once sounds having the identical strength are simultaneously input from the first sound source and the second sound source, the outputs of the directional vibrators 110_*k* are as shown in a graph III combining the graph I with the graph II. As a result, multiple peaks are formed in an angle range of 180°. Thus, the control circuit 140 may analyze the outputs of the directional vibrators 110_*k* and determine that there are two or more sound sources in the case that strengths of output signals of the plurality of directional vibrators 110_*k* arranged in the angle range of 180° have two or more peaks. Alternatively, the control circuit 140 may determine that there are two or more sound sources in the case that clear peaks and clear lowest points are not found in the outputs of the directional vibrators 110_*k*.

Figure 10:
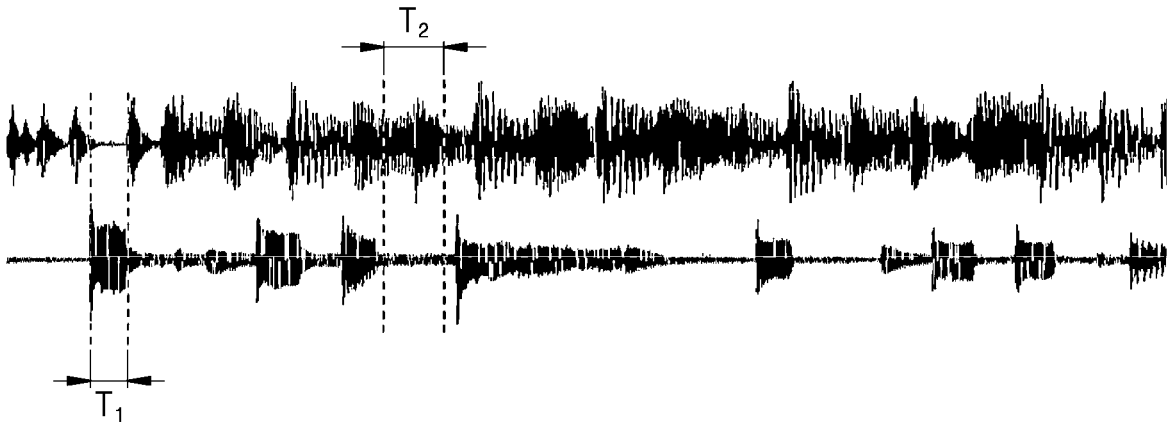
FIG. 10 illustrates a waveform of a sound output from two different sound sources.

Strengths of sounds coming from the first sound source and the second sound source, respectively, may increase or decrease with respect to time. For example, FIG. 10 illustrates a waveform of a sound output from two different sound sources. As illustrated in FIG. 10, the sound coming from the first sound source and the sound coming from the second sound source repeatedly increase or decrease over time. There is also a moment when the sound from the first sound source decreases and at the same time, the sound from the second sound source increases or when the sound from the second sound source decreases and at the same time, the sound from the first sound source increases. For example, in FIG. 10, during a time $T_1$, the sound from the first sound source is weak and the sound from the second sound source is strong. During a time $T_2$, the sound from the second sound source is weak and the sound from the first sound source is strong.

The control circuit 140 may determine a direction of the second sound source during the time $T_1$ and a direction of the first sound source during the time $T_2$. For example, the control circuit 140 may analyze the outputs of the directional vibrators 110_*k* and determine a direction of one sound source during a time in which the strengths of the output signals of the plurality of directional vibrators 110_*k* arranged in the angle range of 180° have one clear peak and one clear lowest point. Referring to the graphs of FIG. 9, at a moment when the outputs of the directional vibrators 110_*k* change from the graph III to the graph I, the control circuit 140 may determine the direction of the first sound source. At a moment when the outputs of the directional vibrators 110_*k* change from the graph III to the graph II, the control circuit 140 may determine the direction of the second sound source.

After the control circuit 140 determines the direction of the first sound source and the direction of the second sound source, the control circuit 140 may select a directional vibrator for obtaining information about a sound coming from the first sound source and a directional vibrator for obtaining information about a sound coming from the second sound source from among the plurality of directional vibrators 110_*k*. In particular, the control circuit 140 may select two directional vibrators to effectively separate and obtain the sound coming from the first sound source and the sound coming from the second sound source.

As illustrated in FIG. 7, a directional vibrator is most sensitive to a sound coming in a longitudinal direction thereof. As an angle difference between a longitudinal direction of a directional vibrator and a direction of a sound increases, a sensitivity of the directional vibrator gradually decreases, and a sensitivity of the directional vibrator becomes minimum with respect to a sound coming in perpendicular to the longitudinal direction of the directional vibrator. In the example of FIG. 7, the sensitivity of the directional vibrator does not largely decrease up to ±30 degrees with respect to the longitudinal direction of the directional vibrator and the sensitivity decreases to about −5 dB at about ±60 degrees. The sensitivity decreases to less than about −15 dB at about ±90 degrees. The directional vibrator may be selected to minimize crosstalk based on such directional characteristics of the directional vibrator.

For example, FIGS. 11A through 11D illustrate examples in which directional vibrators are selected for sound separation in various situations. In FIGS. 11A through 11D, regions A and B marked as fan shapes indicate angle ranges in which a selected directional vibrator is capable of obtaining a sound well.

Figure 11A:
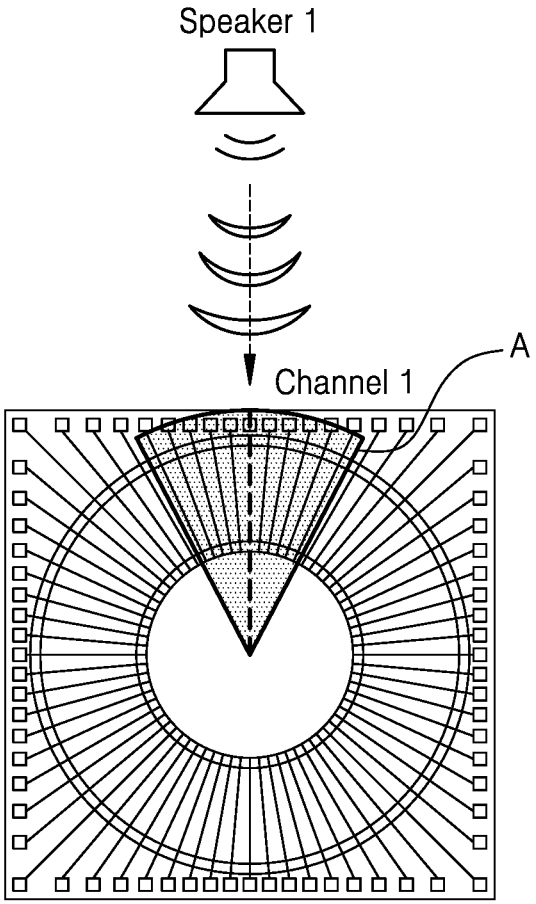
FIGS. 11A through 11D illustrate examples in which directional vibrators are selected for sound separation in various situations.

First, FIG. 11A shows a case where one sound source is arranged in the direction of 0°. In this case, a directional vibrator arranged in the direction of a sound source may be simply selected from among the plurality of directional vibrators 110_*k* to obtain sound information. In FIG. 11A, a plurality of lines extending in a radial direction indicate the plurality of directional vibrators 110_*k* among which a selected directional vibrator is indicated by a dashed line.

Figure 11B:
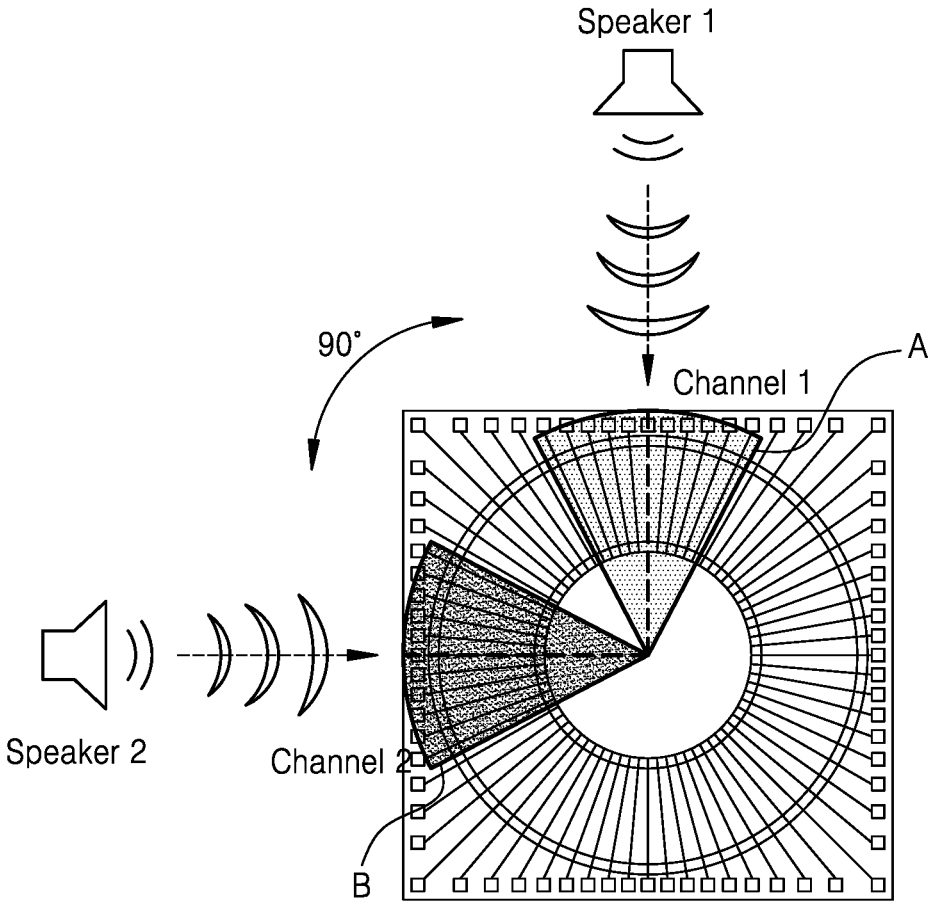

FIG. 11B shows a case where the first sound source and the second sound source are separated apart from each other by about 90 degrees. Also, in this case, a first directional vibrator arranged in the direction of the first sound source may be selected from among the plurality of directional vibrators 110_*k* to obtain sound information from the first sound source based on an output signal of the first directional vibrator. A second directional vibrator arranged in the direction of the second sound source may be selected from among the plurality of directional vibrators 110_*k* to obtain sound information from the second sound source based on an output signal of the second directional vibrator. In this case, because a direction of the sound coming from the first sound source is perpendicular to the longitudinal direction of the second directional vibrator, the sound from the first sound source has a small influence upon the second directional vibrator. Likewise, because a direction of the sound coming from the second sound source is perpendicular to the longitudinal direction of the first directional vibrator, the sound from the second sound source has a small influence upon the first directional vibrator. Thus, when the first sound source and the second sound source are separated apart from each other by about 90 degrees or more, the control circuit 140 may select a directional vibrator having the highest sensitivity to the direction of the first sound source as the first directional vibrator among the plurality of directional vibrators 110_*k* and a directional vibrator having the highest sensitivity to the direction of the second sound source as the second directional vibrator among the plurality of directional vibrators 110*k*.

Figure 11C:
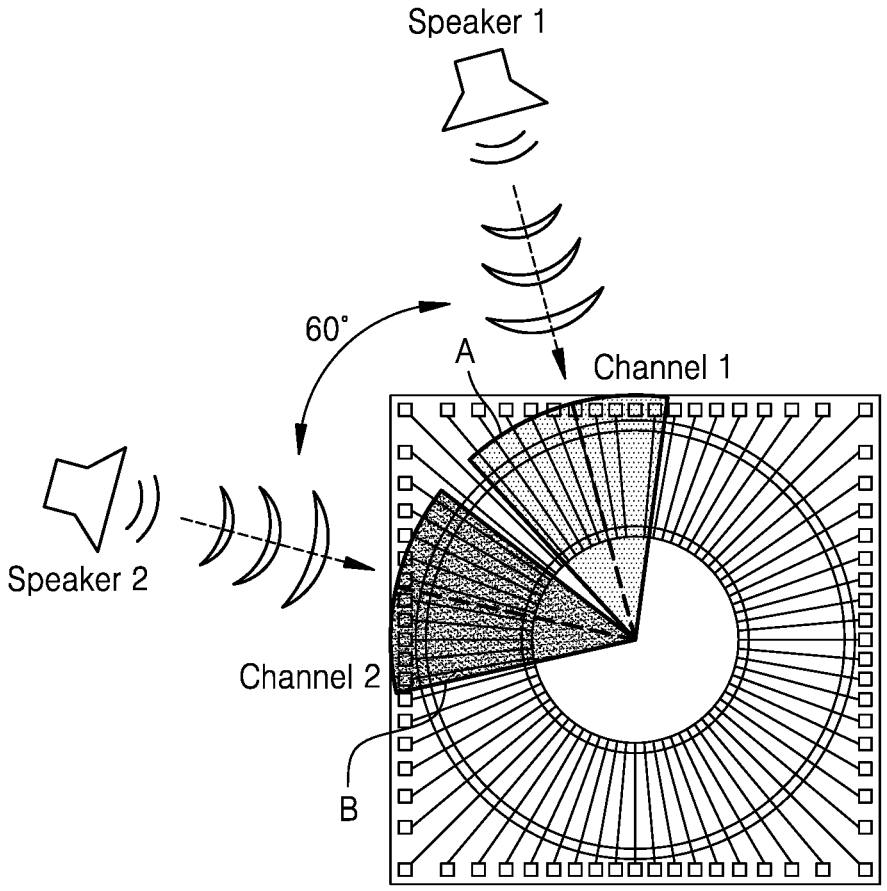

FIG. 11C shows a case where the first sound source and the second sound source are separated apart from each other by less than 90 degrees. For example, in FIG. 11C, an angle between the first sound source and the second sound source may be about 60 degrees. In an example of FIG. 11C, like in the example of FIG. 11B, the first directional vibrator arranged in the direction of the first sound source is selected from among the plurality of directional vibrators 110_*k* to obtain sound information of the first sound source, and the second directional vibrator arranged in the direction of the second sound source is selected to obtain sound information of the second sound source. In other words, a directional vibrator having the highest sensitivity to the direction of the first sound source is selected as the first directional vibrator among the plurality of directional vibrators 110_*k*, and a directional vibrator having the highest sensitivity to the direction of the second sound source is selected as the second directional vibrator among the plurality of directional vibrators 110*k*.

However, in the case that the directional vibrator having the highest sensitivity is selected even when the angle between the first sound source and the second sound source is less than about 90 degrees, interference may increase, hindering sufficient sound source separation. For example, the sound of the second sound source received by the selected first directional vibrator may increase and the sound of the first sound source received by the selected second directional vibrator may increase. Then, noise may increase in the sounds respectively received by the first directional vibrator and the second directional vibrator.

Figure 11D:
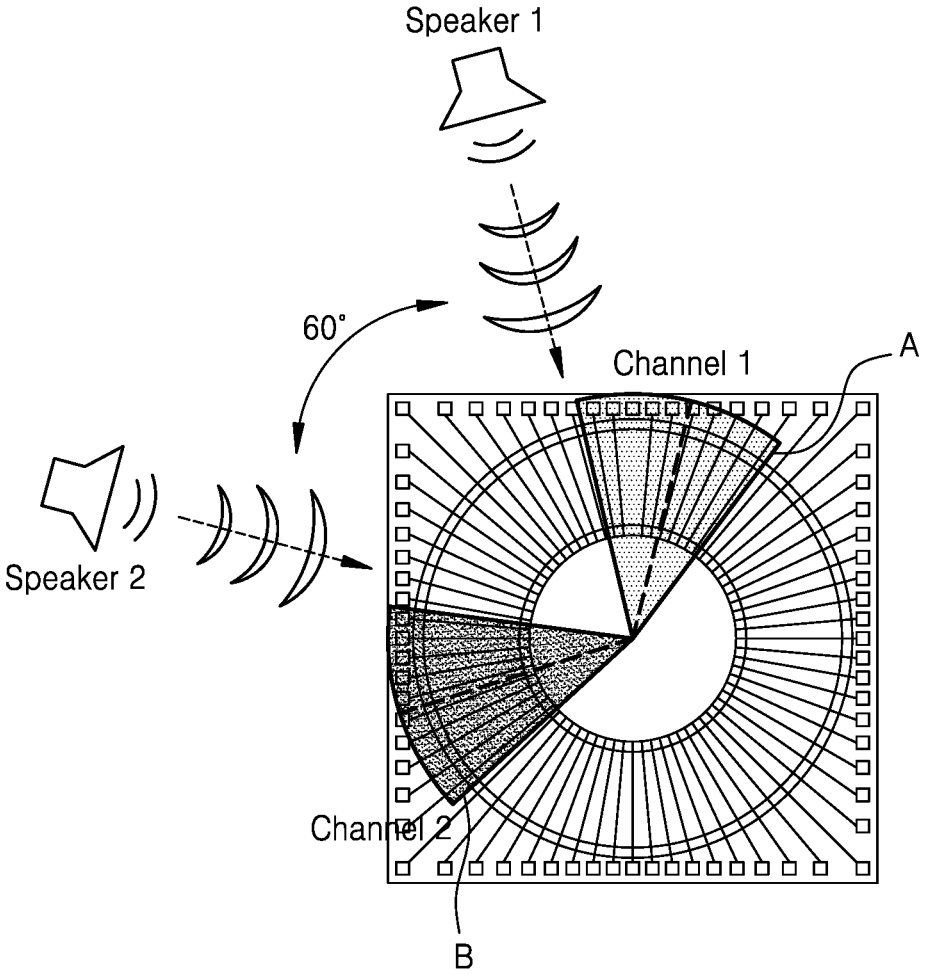

FIG. 11D illustrates an example where a directional vibrator is selected in a manner different from that used in FIG. 11C in the case that an angle between the first sound source and the second sound source is 60 degrees. In FIG. 11D, a directional vibrator having the lowest sensitivity with respect to a sound source other than a target sound source is selected. For example, among the plurality of directional vibrators 110_*k*, a directional vibrator having the lowest sensitivity to the second sound source while sufficiently obtaining a sound from the first sound source may be selected to obtain sound information of the first sound source and a directional vibrator having the lowest sensitivity to the first sound source while sufficiently obtaining a sound from the second sound source may be selected to obtain sound information of the second sound source.

In other words, the control circuit 140 may select a directional vibrator having the lowest sensitivity with respect to the direction of the second sound source as the first directional vibrator from among the plurality of directional vibrators 110_*k* arranged within an angle range around the direction of the first sound source. The control circuit 140 may select a directional vibrator having the lowest sensitivity with respect to the direction of the first sound source as the second directional vibrator from among the plurality of directional vibrators 110_*k* arranged within an angle range around the direction of the second sound source. In the example of FIG. 11D, a directional vibrator located in a direction of +30 degrees is selected as the first directional vibrator, and a directional vibrator located in a direction of −120 degrees is selected as the second directional vibrator. The first directional vibrator is separated apart from the second sound source by 90 degrees, and the second directional vibrator is separated apart from the first sound source by 90 degrees.

After the first directional vibrator and the second directional vibrator are selected, the sound of the first sound source and the sound of the second sound source may be obtained using the first directional vibrator and the second directional vibrator, respectively. Letting an output signal of the first directional vibrator be C1, an output signal of the second directional vibrator be C2, a sound signal of the first sound source be S1, and a sound signal of the second sound source be S2; then, C1=S1 in FIG. 11A.

In FIG. 11B, $C1=S1+\frac{1}{10}\times S2$ and $C2=\frac{1}{10}\times S1+S2$. Herein, $\frac{1}{10}$ may be determined as an example based on the directional characteristics of a directional vibrator in the example illustrated in FIG. 7 and may vary with directional characteristics of the directional vibrator. In FIG. 11B, the sound of the second sound source, received in the first directional vibrator, is about $\frac{1}{10}$ of the sound of the first sound source, such that sufficient sound source separation is possible.

In FIG. 11C, $C1=S1+\frac{1}{2}\times S2$ and $C2=\frac{1}{2}\times S1+S2$. Herein, $\frac{1}{2}$ may be determined as an example based on the directional characteristics of a directional vibrator in the example illustrated in FIG. 7 and may vary with directional characteristics of the directional vibrator. In FIG. 11C, because a ratio of S1 to S2 is 2:1 in C1, sound source separation may not be sufficiently performed.

In FIG. 11D, $C1=\frac{4}{5}\times S1+\frac{1}{10}\times S2$ and $C2=\frac{1}{10}\times S1+\frac{4}{5}\times S2$. Herein, $\frac{4}{5}$ and $\frac{1}{10}$ may be determined as an example based on the directional characteristics of a directional vibrator in the example illustrated in FIG. 7 and may vary with directional characteristics of the directional vibrator. In FIG. 11D, because a ratio of S1 to S2 is 8:1 in C1, sound source separation may be sufficiently performed.

Figure 12:
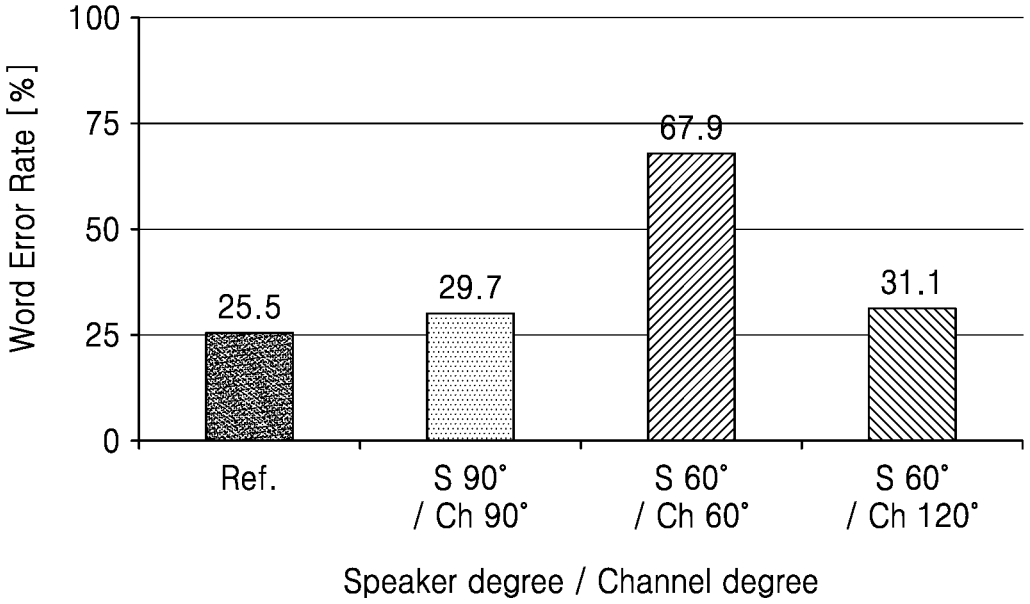
FIG. 12 is a graph illustrating a voice recognition test result with respect to a combination of selected directional vibrators.

FIG. 12 is a graph illustrating a voice recognition test result with respect to a combination of selected directional vibrators. A voice recognition test has been carried out in a manner in which sounds including multiple words are output from the first sound source and the second sound source, respectively, and a rate of the number of words recognized inaccurately by a selected directional vibrator is measured. The leftmost graph corresponds to a case of FIG. 11A in which a rate of inaccurate recognition is about 25.5%. Since one sound source is used, the case of FIG. 11A may be used as a reference where there is an influence of interference when two sound sources are used. The second graph from the left corresponds to a case of FIG. 11B in which a rate of inaccurate recognition is about 29.7%, which increases slightly from the reference. The third graph from the left corresponds to a case of FIG. 11C in which a rate of inaccurate recognition is about 67.9%, which increases greatly from the reference. The rightmost graph corresponds to a case of FIG. 11D in which a rate of inaccurate recognition is about 31.1%, showing a result similar with the case of FIG. 11B. Thus, by selecting the directional vibrator having the lowest sensitivity with respect to a sound source other than the target sound source, sound source separation may be sufficiently achieved.

The sound source separation apparatuses 100 and 101 may separate sounds coming from two different sound sources simply in terms of hardware merely with the plurality of directional vibrators 110_*k* without a need for complex computational processing. Thus, the sound source separation apparatuses 100 and 101 may be miniaturized and thus mounted on a small-size electronic product. The electronic product having mounted thereon the sound source separation apparatus 100 or 101 according to the current embodiment of the disclosure may relatively accurately separate a user's sound source even in a noisy environment.

The foregoing description has been made in which one directional vibrator is selected for one sound source to obtain sound information, but the disclosure is not limited thereto. Depending on a need, one or more adjacent directional vibrators for one sound source, e.g., two or three continuously adjacent directional vibrators, may be selected to obtain sound information. Also in this case, when there are two or more sound sources, a group of directional vibrators having the lowest sensitivity to a sound source other than the target sound source may be selected.

So far, a description has been made in which a sound source is separated merely with an output signal of a selected directional vibrator without separate signal processing in terms of software to obtain sound information. For example, sound information of the first sound source may be obtained with the output signal of the first directional vibrator selected for the first sound source, and the sound information of the second sound source may be obtained with the output signal of the second directional vibrator selected for the second sound source. However, sound source separation may be performed by computing the output signal of the first directional vibrator and the output signal of the second directional vibrator in terms of software. For example, in the example of FIG. 11C, $C1=S1+\frac{1}{2}\times S2$ and $C2=\frac{1}{2}\times S1+S2$, such that C1 may be expressed with S1 and C2 may be expressed with S2 by solving simultaneous equations. More specifically, $C1'=C1-\frac{1}{2}\times C2=\frac{3}{4}\times S1$ and $C2'=C2-\frac{1}{2}\times C1=\frac{3}{4}\times S2$.

Thus, when a rate of the sound of the second sound source contributing to the output signal of the first directional vibrator selected for the first sound source and a rate of the sound of the first sound source contributing to the output signal of the second directional vibrator selected for the second sound source are given, the control circuit 140 may obtain sound information of the first sound source and sound information of the second sound source by computing the output signal of the first directional vibrator and the output signal of the second directional vibrator. More generally, letting the output signal of the first directional vibrator be C1, the output signal of the second directional vibrator be C2, the sound signal of the first sound source be S1, the sound signal of the second sound source be S2, a rate of the sound of the second sound source contributing to the output signal of the first directional vibrator be α, and a rate of the sound of the first sound source contributing to the output signal of the second directional vibrator be β;

then $C1=S1+\alpha S2$ and $C2=S2+\beta S1$, and

S1 and S2 may be expressed with C1 and C2 as $S1=(C1-\alpha C2)/(1-\alpha\beta)$ and $S2=(C2-\beta C1)/(1-\alpha\beta)$.

Herein, α and μ indicate unique sensitivity characteristics of the first directional vibrator and the second directional vibrator with respect to a direction of an incident sound, and may be known in advance by measurement. For example, α may be determined based on an angle between the first directional vibrator and the second sound source, and β may be determined based on an angle between the second directional vibrator and the first sound source. In the case that all of the directional vibrators 110_*k* included in the sound source separation apparatuses 100 and 101 have the same directional characteristics, α and β may have an identical value. However, when the directional vibrators 110_*k* have different directional characteristics, α and β may have different values.

Values of sensitivity of each directional vibrator measured in advance with respect to a direction of a sound incident to each directional vibrator may be stored in the memory 141. For example, a pair of an incident angle of a sound incident to each directional vibrator and a corresponding sensitivity may be stored in the memory 141. The control circuit 140 may then obtain α and β from sensitivity characteristics of the directional vibrators stored in the memory 141 and compute the output signal of the first directional vibrator and the output signal of the second directional vibrator based on α and β, thus obtaining the sound information of the first sound source and the sound information of the second sound source. Hence, a directional vibrator having the highest sensitivity with respect to a direction of a target sound source may be selected from among the plurality of directional vibrators 110_*k*, and then sound source separation may be performed through software signal processing.

Figure 13:
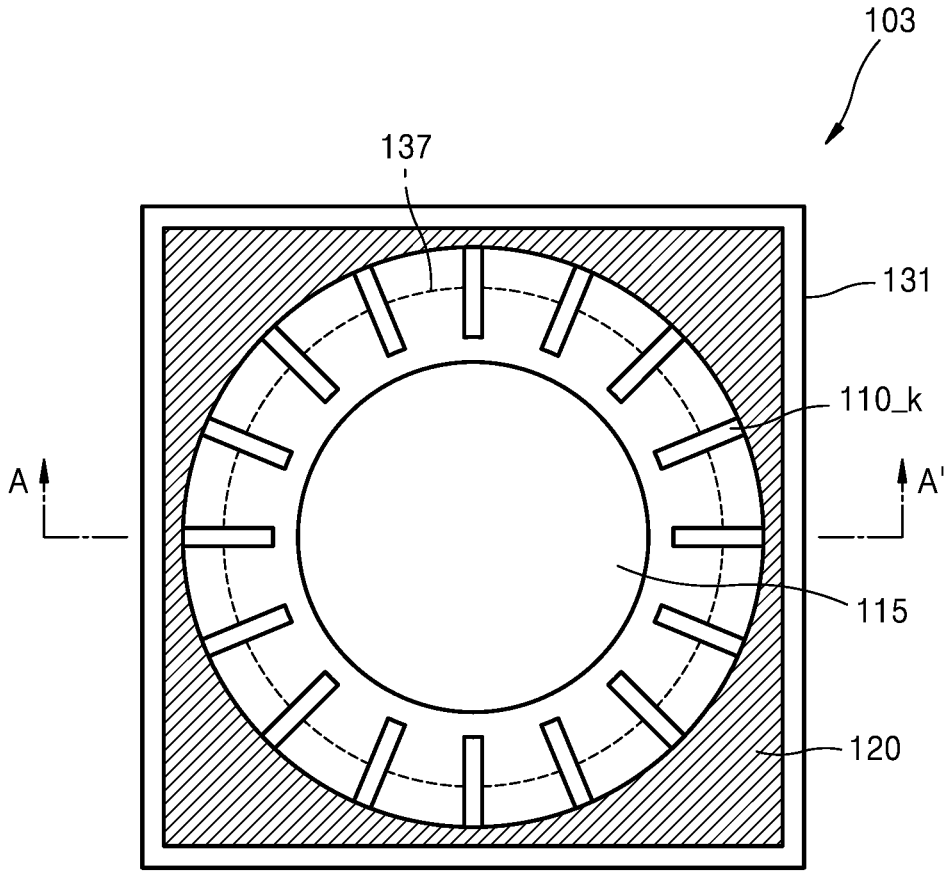
FIG. 13 is a plan view illustrating a schematic structure of a sound source separation apparatus according to another embodiment of the disclosure.
Figure 14:
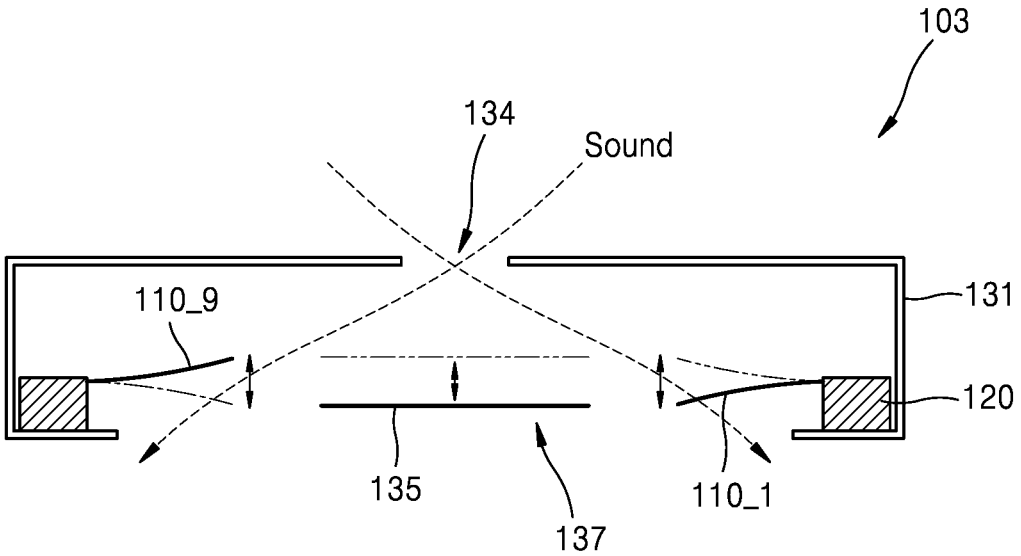
FIG. 14 is a cross-sectional view taken along line A-A' of the sound source separation apparatus illustrated in FIG. 13.

FIG. 13 is a plan view of a sound source separation apparatus according to another embodiment of the disclosure, and FIG. 14 is a cross-sectional view taken along line A-A' of the sound source separation apparatus of FIG. 13. Referring to FIGS. 13 and 14, a sound source separation apparatus 103 may further include an omnidirectional vibrator 115 reacting to an input sound regardless of a direction thereof. The other elements of the sound source separation apparatus 103 of FIGS. 13 and 14 may be the same as those of the sound source separation apparatus 101 of FIGS. 4 and 5.

The omnidirectional vibrator 115 may be located, for example, in the sound outlet 137 and may be located on the same plane as the plurality of directional vibrators 110_*k*. In this case, the plurality of directional vibrators 110_*k* may be arranged to surround the omnidirectional vibrator 115. However, the omnidirectional vibrator 115 is not limited to the above-described location and may also have various other locations. For example, the omnidirectional vibrator 115 may be located outside the case 131.

Unlike the directional vibrators 110_*k*, the omnidirectional vibrator 115 may have almost the same output in reaction to sound input from all directions. To this end, the omnidirectional vibrator 115 may have a form of a circular thin film. When the omnidirectional vibrator 115 is located in the sound outlet 137, the omnidirectional vibrator 115 may be located in such a manner that the center of the circular omnidirectional vibrator 115 is aligned with a center point of the sound outlet 137.

Although the output of the omnidirectional vibrator 115 is constant regardless of the direction of the input sound, a phase of vibration of the omnidirectional vibrator 115 may vary depending on the direction of the input sound. For example, as schematically illustrated in FIG. 14, the phase of vibration of the omnidirectional vibrator 115 may be the same as a phase of vibration of the directional vibrator 110_1 that is located in the direction of the input sound among the directional vibrators 110_*k*. In addition, the phase of vibration of the omnidirectional vibrator 115 may be opposite to a phase of vibration of the directional vibrator 110_9 located in a direction opposite to the direction of the input sound among the directional vibrators 110_*k*.

Figure 15:
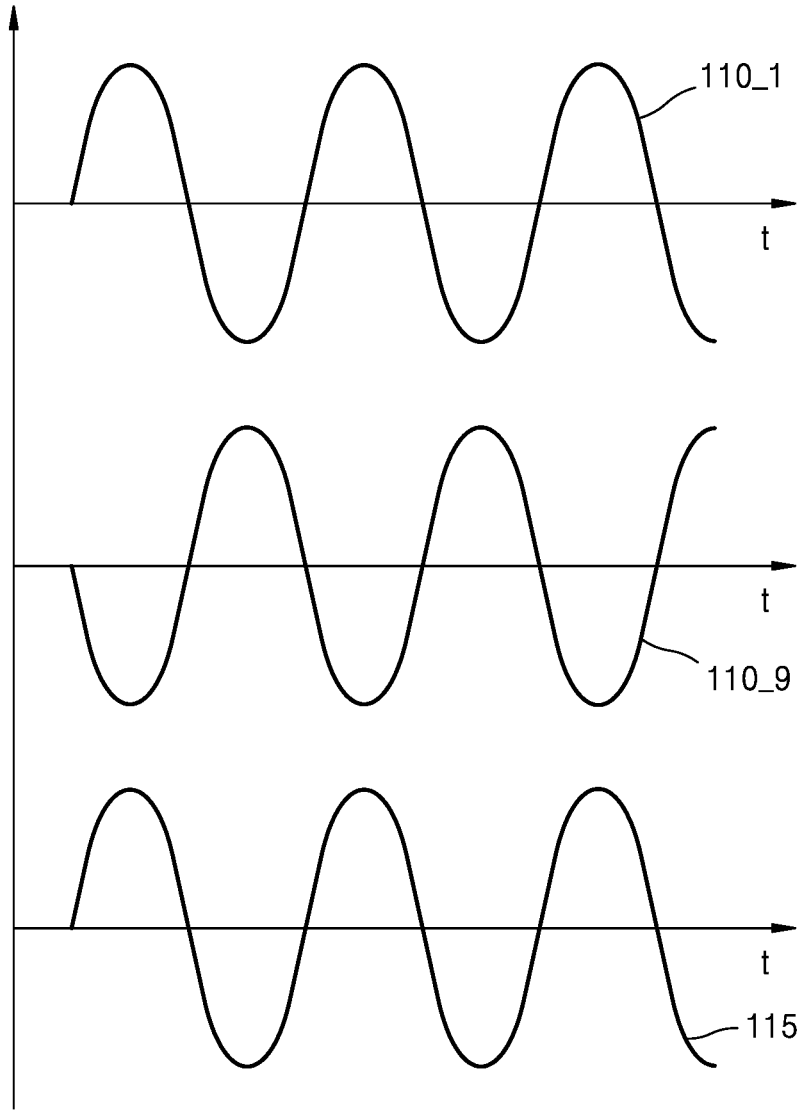
FIG. 15 is a graph showing an example of phases of vibration of one omnidirectional vibrator and two directional vibrators facing each other in a case when sound is input from one direction.

FIG. 15 is a graph showing an example of phases of vibration of the omnidirectional vibrator 115 and the two directional vibrators 110_1 and 110_9 facing each other in a case when sound is input from one direction. For example, it is assumed that the directional vibrators 110_1 and 110_9 are located to face each other and that sound is input in a direction from the directional vibrator 110_1 toward the directional vibrator 110_9. As illustrated in FIG. 15, the phase of vibration of the directional vibrator 110_1 is 180° opposite to the phase of vibration of the directional vibrator 110_9. The phase of vibration of the omnidirectional vibrator 115 is the same as the phase of vibration of the directional vibrator 110_1 and is 180° opposite to the phase of vibration of the directional vibrator 110_9.

Therefore, a direction of the sound source may be accurately detected with reference to phases of vibration of the omnidirectional vibrator 115 and the directional vibrators 110_*k*. For example, the control circuit 140 may select a directional vibrator having the lowest strength of an output signal from among the plurality of directional vibrators 110_*k*. The control circuit 140 may compare a phase of a directional vibrator arranged at +90° with respect to the directional vibrator having the lowest output signal strength and a phase of a directional vibrator arranged at −90° with respect the directional vibrator having the lowest output signal strength with a phase of the omnidirectional vibrator 115. Then, the control circuit 140 may determine as a direction of a sound source, an arrangement direction of a directional vibrator having the closest phase to that of the omnidirectional vibrator 115.

The sound source separation apparatuses 100, 101, 102, and 103 according to the afore-described embodiments of the disclosure may be applied in various electronic apparatuses. The sound source separation apparatuses 100, 101, 102, and 103 may be implemented as chip-solution sensors and may perform tracking of a plurality of sound sources, noise cancellation, and spatial recording in the field of mobile devices, information technology (IT), home appliances, and vehicles or may be used in the field of panoramic shooting, augmented reality, and virtual reality.

Hereinbelow, electronic apparatuses using the above-described sound source separation apparatuses 100, 101, 102, and 103 will now be described.

Figure 16:
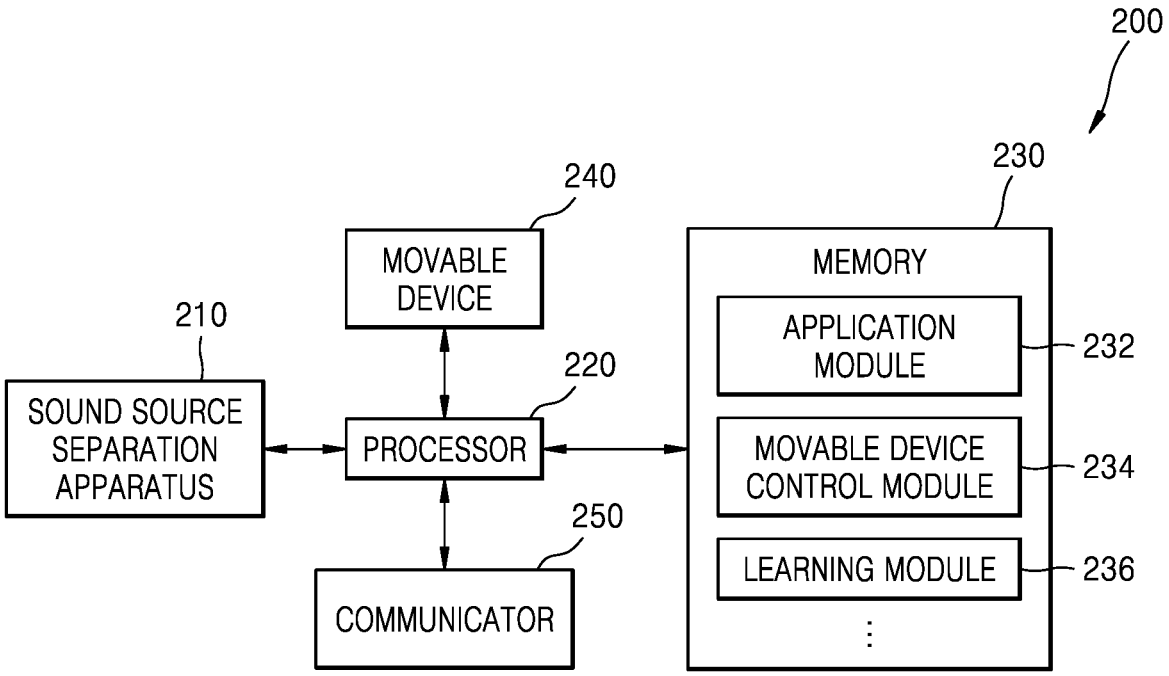
FIG. 16 is a block diagram illustrating a schematic structure of an Internet of things (IoT) apparatus according to an embodiment of the disclosure.
Figure 17:
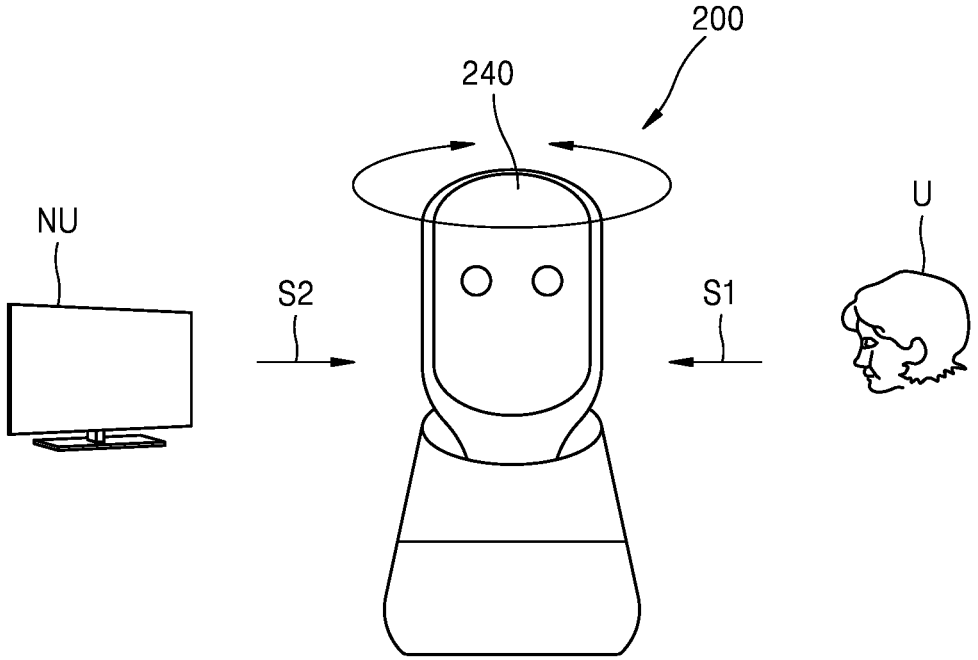
FIG. 17 is a schematic diagram for describing an example of operation of the IoT apparatus of FIG. 16 in daily life.

FIG. 16 is a block diagram illustrating a schematic structure of an Internet of things (IoT) apparatus according to an embodiment of the disclosure, and FIG. 17 is a schematic diagram for describing an example of operation of the IoT apparatus of FIG. 16 in daily life.

An IoT apparatus 200 may include a sound source separation apparatus 210 that receives a speech signal provided by a user, a memory 230 in which one or more application modules 232 using the signal received by the sound source separation apparatus 210 as an input variable are stored, and a processor 220 that executes the application modules 232. The IoT apparatus 200 may further include a communicator 250.

The IoT apparatus 200 may further include a movable device 240 capable of rotating or moving. The movable device 240 may be controlled in terms of rotation or movement in a direction based on an execution result of the application modules 232 executed using the signal received by the sound source separation apparatus 210 as an input variable. The direction of rotation or motion may be, for example, a direction facing or avoiding a direction of sound detected by the sound source separation apparatus 210. The movable device 240 may be implemented to have an output function capable of outputting the execution result of the application module 232 to the user. The movable device 240 may be an output device, e.g., a speaker or a display. The sound source separation apparatus 210 may include any one of, a modification of, or a combination of the sound source separation apparatuses 100, 101, 102, and 103 according to the afore-described embodiments of the disclosure.

The processor 220 may control all operations of the IoT apparatus 200. The processor 220 may control operations of the sound source separation apparatus 210, the movable device 240, and the communicator 250, use related control signals, and execute programs stored in the memory 230. The memory 230 may include a movable device control module 234 programmed to rotate or move the movable device 240 in a certain direction based on a control signal. The movable device control module 234 may control the movable device 240 to rotate or move in a direction facing or avoiding the direction of sound detected by the sound source separation apparatus 210, by using a signal detected by the sound source separation apparatus 210 and an execution result of an application associated with the signal. However, this is only an example, and a movable device control direction based on an application execution result reflecting the signal sensed by the sound source separation apparatus 210 may be various.

The memory 230 may further include a learning module 236 programmed to learn whether the signal received by the sound source separation apparatus 210 is a valid input signal, in association with the direction of sound. For example, the learning module 236 may repeatedly generate and accumulate, as learning data, the direction of sound detected by the sound source separation apparatus 210 and a result of determining whether the signal is a valid signal, and extract statistic features from the accumulated learning data, thereby treating sound input from a certain direction, as an invalid signal. For example, a sound coming from a direction that is different from a user's voice may be processed as noise, or voices of a plurality of users in different directions may be separately recognized. The memory 230 may also store various other programs and data required for the processor 220 to control overall operations of the IoT apparatus 200.

The memory 230 may include at least one type of storage medium among, for example, flash memory, a hard disk, a multimedia card micro, card-type memory (e.g., secure digital (SD) or extreme digital (XD) memory), random access memory (RAM), static random-access memory (SRAM), read-only memory (ROM), electrically erasable programmable ROM (EEPROM), programmable ROM (PROM), magnetic memory, a magnetic disc, and an optical disc.

The communicator 250 may communicate with an external device by using, but not limited to, Bluetooth communication, Bluetooth low energy (BLE) communication, near field communication (NFC), wireless local area network (WLAN) communication, Zigbee communication, Infrared Data Association (IrDA) communication, WiFi direct (WFD), ultra-wideband (UWB) communication, Ant+ communication, WiFi communication, or the like.

Referring to FIG. 17, the movable device 240 included in the IoT apparatus 200 is illustrated as a rotatable speaker. A speaker will be described below as an example of the movable device 240, but the movable device 240 is not limited thereto. The IoT apparatus 200 may determine a direction of an input sound signal S1 or S2 and rotate the speaker to face the determined direction. The IoT apparatus 200 may identify a valid signal among the two sound signals S1 and S2 input at the same time.

The IoT apparatus 200 may identify a valid signal among the input sound signals S1 and S2. For example, the IoT apparatus 200 may separately recognize the sound signal S1 from a user U and the sound signal S2 from a sound source NU that is not a user. The IoT apparatus 200 may distinguish between the sound signals S1 and S1 by learning whether an input signal is a valid signal, in association with a direction of input sound. As such, for example, after learning and determining that an invalid signal is continuously input from a certain fixed direction, e.g., a television (TV), the IoT apparatus 200 may rotate the speaker toward the direction of the sound signal S2 that is determined as a valid signal among the input sound signals S1 and S2, and execute an application related to the sound signal S2. The IoT apparatus 200 may be used as an artificial intelligence (AI) speaker and may also be applied to various other objects to enhance utilization of inherent functions of the objects.

Figure 18:
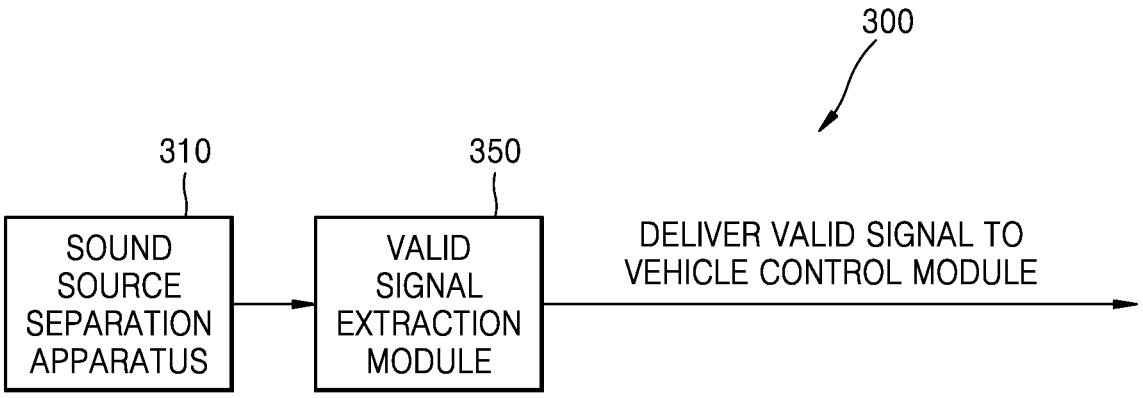
FIG. 18 is a block diagram illustrating a schematic structure of a vehicle voice interface apparatus according to an embodiment of the disclosure.
Figure 19:
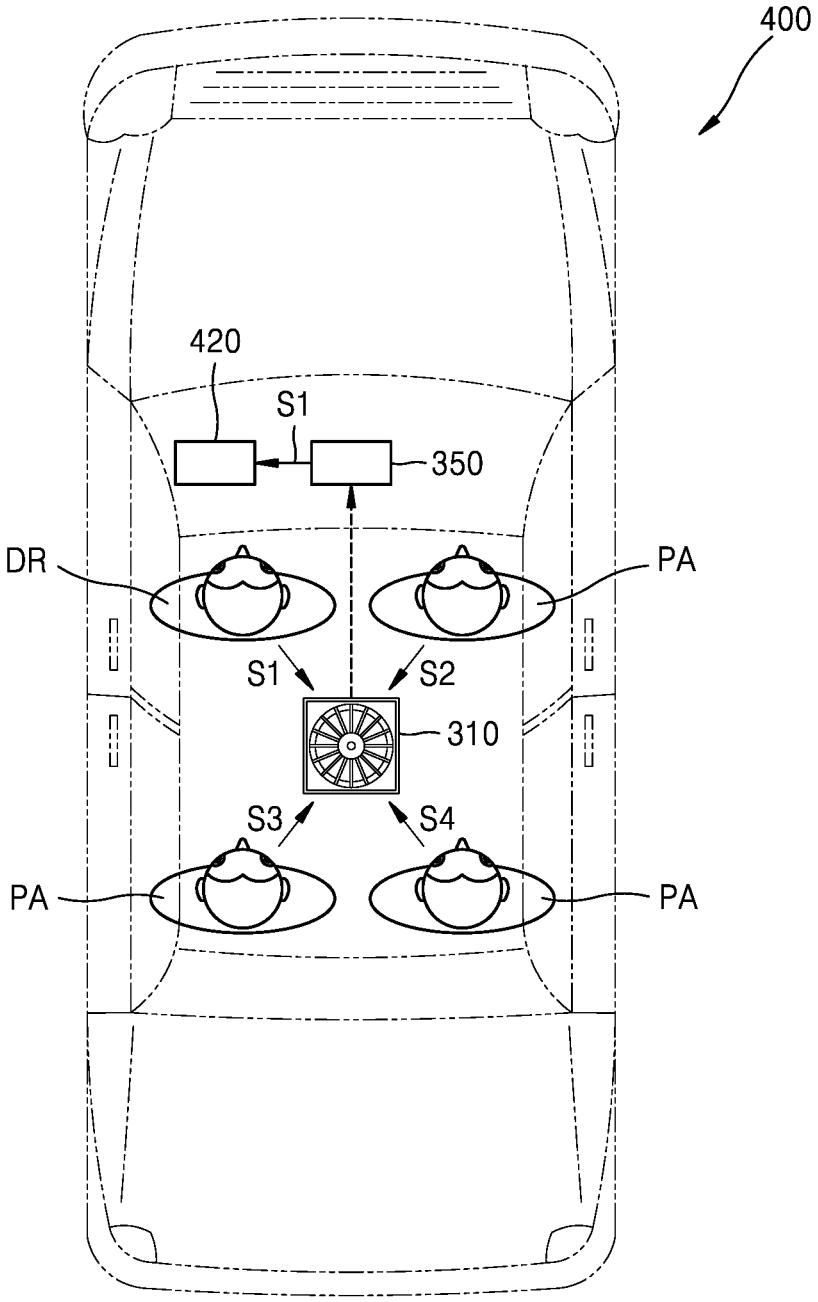
FIG. 19 illustrates an operation where a vehicle voice interface apparatus according to an embodiment of the disclosure is applied to a vehicle.

FIG. 18 is a block diagram of a vehicle voice interface apparatus 300 according to an embodiment, and FIG. 19 is a schematic diagram for describing an example of operation of the vehicle voice interface apparatus 300 in a vehicle 400.

Referring to FIG. 18, the vehicle voice interface apparatus 300 may include a sound source separation apparatus 310 and a valid signal extraction module 350. The valid signal extraction module 350 may include a memory configured to store a program for extracting a valid signal, and a processor configured to execute the program. The sound source separation apparatus 310 may include any one of, a modification of, or a combination of the sound source separation apparatuses 100, 101, 102, and 130 according to the afore-described embodiments of the disclosure.

The valid signal extraction module 350 may determine whether a signal received by the sound source separation apparatus 310 is a valid signal, based on a direction thereof, and transmit the signal to a vehicle control module upon determining that the signal is a valid signal. The valid signal extraction module 350 may separate and then remove sound signals from directions other than a direction of a driver, from a sound signal input from various directions, and transmit the sound signal to the vehicle control module.

Referring to FIG. 19, the sound source separation apparatus 310 included in the vehicle 400 detects a sound signal S1 separately from a driver DR and sound signals S2, S3, and S4 from passengers PA. The sound source separation apparatus 310 may detect directions of the received sound signals S1, S2, S3, and S4 and transmit the result of separately detecting the sound signals S1, S2, S3, and S4 to the valid signal extraction module 350. The valid signal extraction module 350 may transmit only the sound signal S1 from the driver DR to a vehicle control module 420.

Figure 20:
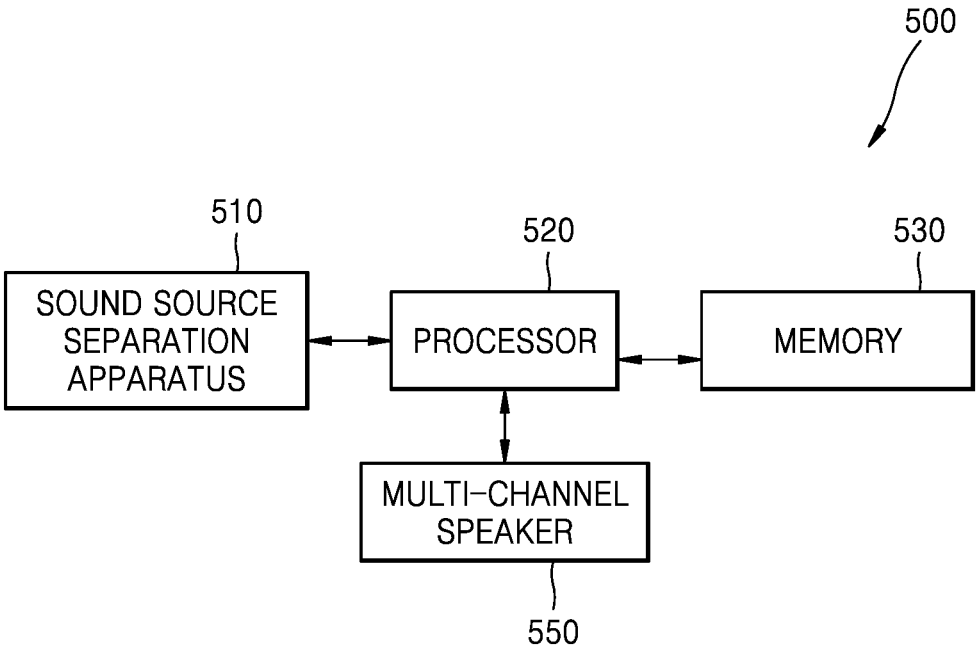
FIG. 20 is a block diagram illustrating a schematic structure of a spatial recording apparatus according to an embodiment of the disclosure.

FIG. 20 is a block diagram of a spatial recording apparatus according to an embodiment of the disclosure. Referring to FIG. 20, a spatial recording apparatus 500 according to an embodiment of the disclosure may include a sound source separation apparatus 510, a processor 520 configured to determine a direction of a sound input to the sound source separation apparatus 510, by analyzing a signal detected by the sound source separation apparatus 510, and a memory 530 configured to store programs for signal processing operations of the processor 520. Also, the memory may store results of the operations performed by the processor 520. The sound source separation apparatus 510 may include any one of, a modification of, or a combination of the sound source separation apparatuses 100, 101, 102, and 103 according to the afore-described embodiments of the disclosure. The sound source separation apparatus 510 may record ambient sound in association with a direction thereof. The sound source separation apparatus 510 may estimate an input direction of sound in a high resolution.

The spatial recording apparatus 500 may selectively record a desired sound source or separately recording sounds of sound sources in different directions, by using the estimation result of the input direction of sound. The spatial recording apparatus 500 may further include a multi-channel speaker 550 to reproduce the recorded sound in accordance with a direction thereof. The processor 520 controls the multi-channel speaker 550 such that a sound signal stored in the memory 530 may be played suitably for a direction. By playing a recorded sound source suitably for a direction, a sense of realism of recorded content may be augmented, and a sense of immersion and a sense of reality may be improved. The spatial recording apparatus 500 may be used in an augmented reality (AR) or virtual reality (VR) apparatus.

Figure 21:
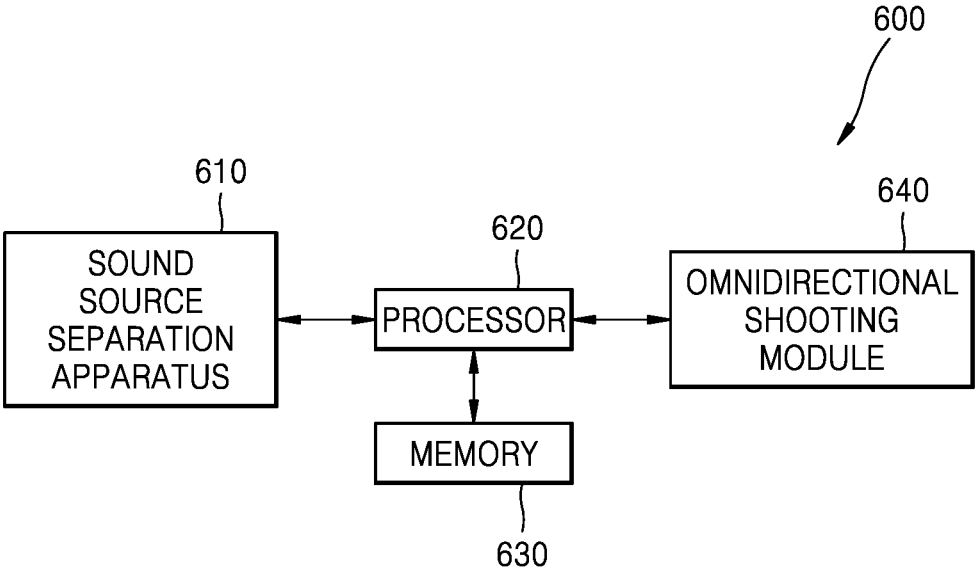
FIG. 21 is a block diagram of an omnidirectional camera according to an embodiment of the disclosure.

FIG. 21 is a block diagram of an omnidirectional camera 600 according to an embodiment of the disclosure. Referring to FIG. 21, the omnidirectional camera 600 according to an embodiment of the disclosure is a camera capable of capturing a panoramic image of objects in all directions. The omnidirectional camera 600 may include a sound source separation apparatus 610, an omnidirectional shooting module 640, a processor 620 configured to control the sound source separation apparatus 610 and the omnidirectional shooting module 640 in such a manner that a directional sound signal detected by the sound source separation apparatus 610 matches an omnidirectional image signal captured by the omnidirectional shooting module 640, and a memory 630 configured to store the directional sound signal and the omnidirectional image signal. The sound source separation apparatus 610 may include any one of, a modification of, or a combination of the sound source separation apparatuses 100, 101, 102, and 103 according to the afore-described embodiments of the disclosure, and may detect sounds from all directions and separate sounds coming from different directions.

A general panoramic shooting module may be used as the omnidirectional shooting module 640. For example, the omnidirectional shooting module 640 may include optical lenses, an image sensor, etc. in a 360°-rotatable body. Under control of the processor 620, a sound in a direction corresponding to a photographing direction of the omnidirectional shooting module 640, among signals sensed by the sound source separation apparatus 610, may be separated and selectively stored in the memory 630. As such, the omnidirectional camera 600 may store a 360° panoramic image signal and a sound signal matching the image signal, in the memory 630. The image and sound signals may be reproduced by a display device including a multi-channel speaker, may maximize a sense of realism, and may be used in an AR/VR device.

According to an embodiment, a hybrid technique, in which, the sound separation devices and methods of the disclosure are combined with the techniques of ICA, GSS or DNN. For instance, according to an embodiment, a first result from source separation device of the disclosure can be used in conjunction with the analysis methods of ICA, GSS and DNN to further improve measurable characteristics such as accuracy, etc.

Electronic apparatuses according to the afore-described embodiments of the disclosure may include a processor, a memory configured to store and execute program data, a permanent storage such as a disk drive, a communication port configured to communicate with an external device, and a user interface device, e.g., a touch panel, keys, or buttons.

Methods implemented using software modules or algorithms in the electronic apparatuses according to the afore-described embodiments of the disclosure may be recorded on a computer-readable recording medium as computer-readable codes or program instructions executable by the processor. Examples of the computer-readable recording medium include magnetic storage media (e.g., read-only memory (ROM), random-access memory (RAM), floppy disks, and hard disks) and optical recording media (e.g., compact disc-ROM (CD-ROM) and digital versatile discs (DVDs)). The computer-readable recording medium may also be distributed over network coupled computer systems so that a computer-readable code is stored and executed in a distributed fashion. The medium may be read by a computer, stored in a memory, and executed by a processor.

Although the sound source separation apparatus and the sound source separation method have been described with reference to the embodiments of the disclosure shown in the drawings, they may also be replaced with a resonance structure having one resonator as mentioned above. It should be understood that embodiments of the disclosure described herein should be considered in a descriptive sense only and not for purposes of limitation. Descriptions of features or aspects within each embodiment should typically be considered as available for other similar features or aspects in other embodiments of the disclosure. The scope of the embodiments of the disclosure will be in the appended claims, and all of the differences in the equivalent range thereof should be understood to be included in the embodiments of the disclosure.

What is claimed is:

1. A sound source separation apparatus comprising:

a sound inlet configured to receive a sound;

a sound outlet configured to output the sound received through the sound inlet;

a plurality of directional vibrators arranged on a plane between the sound inlet and the sound outlet, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet; and a control circuit configured to:

determine a first direction of a first sound source and a second direction of a second sound source that is different from the first sound source, based on strengths of output signals of the plurality of directional vibrators, and select a first directional vibrator and a second directional vibrator from among the plurality of directional vibrators to separately obtain a first sound from the first sound source and a second sound from the second sound source, wherein the first directional vibrator is different from the second directional vibrator.

2. The sound source separation apparatus of claim 1, wherein the control circuit is further configured to obtain first information about the first sound from the first sound source based on a first output signal of the first directional vibrator and second information about the second sound from the second sound source based on a second output signal of the second directional vibrator.

3. The sound source separation apparatus of claim 2, wherein the control circuit is configured to select a directional vibrator having a highest sensitivity to the first direction of the first sound source, among the plurality of directional vibrators, as the first directional vibrator and select a directional vibrator having a highest sensitivity to the second direction of the second sound source, among the plurality of directional vibrators, as the second directional vibrator.

4. The sound source separation apparatus of claim 2, wherein the control circuit is further configured to select a directional vibrator arranged in the first direction of the first sound source, among the plurality of directional vibrators, as the first directional vibrator and select a directional vibrator arranged in the second direction of the second sound source, among the plurality of directional vibrators, as the second directional vibrator.

5. The sound source separation apparatus of claim 4, wherein the control circuit is further configured to obtain the first information about the first sound from the first sound source and the second information about the second sound from the second sound source by computing a first output signal and a second output signal based on a first rate of the second sound of the second sound source contributing to the first output signal of the first directional vibrator and a second rate of the first sound of the first sound source contributing to the second signal of the second directional vibrator.

6. The sound source separation apparatus of claim 5, wherein, in a case that the first output signal of the first directional vibrator is C1, the second output signal of the second directional vibrator is C2, a first sound signal of the first sound source is S1, a second sound signal of the second sound source is S2, the first rate of the second sound of the second sound source contributing to the first output signal of the first directional vibrator is a, and the second rate of the first sound of the first sound source contributing to the second output signal of the second directional vibrator is β, then $C1=S1+\alpha S2$ and $C2=S2+\beta S1$, and $S1=(C1-\alpha C2)/(1-\alpha\beta)$ and $S2=(C2-\beta C1)/(1-\alpha\beta)$.

7. The sound source separation apparatus of claim 5, wherein the first rate of the second sound of the second sound source contributing to the first output signal of the first directional vibrator is determined by a first angle between the first directional vibrator and the second sound source, and the second rate of the first sound of the first sound source contributing to the second output signal of the second directional vibrator is determined by a second angle between the second directional vibrator and the first sound source.

8. The sound source separation apparatus of claim 7, further comprising a memory configured to store sensitivity information of each directional vibrator with respect to a direction of a sound incident to each directional vibrator.

9. The sound source separation apparatus of claim 2, wherein the control circuit is further configured to select a directional vibrator having a lowest sensitivity to the second direction of the second sound source, among a plurality of directional vibrators arranged in a first angle range around the first direction of the first sound source, as the first directional vibrator and select a directional vibrator having a lowest sensitivity to the first direction of the first sound source, among the plurality of directional vibrators arranged in a second angle range around the second direction of the second sound source, as the second directional vibrator.

10. The sound source separation apparatus of claim 1, wherein the control circuit is further configured to determine the second direction of the second sound source during a first time in which the first sound from the first sound source decreases and determine the first direction of the first sound source during a second time in which the second sound from the second sound source decreases.

11. The sound source separation apparatus of claim 10, wherein the control circuit is further configured to determine that there are two or more sound sources in a case that strengths of output signals of a plurality of directional vibrators arranged in a range of 180 degrees have two or more peaks, and determine a direction of a sound source during a time in which the strengths of the output signals of the plurality of directional vibrators arranged in the range of 180 degrees have one peak.

12. The sound source separation apparatus of claim 1, wherein the control circuit is further configured to determine an arrangement direction of a directional vibrator having a highest strength of an output signal, among the plurality of directional vibrators, as the first direction of the first sound source or the second direction of the second sound source.

13. The sound source separation apparatus of claim 1, wherein the control circuit is further configured to determine a direction perpendicular to an arrangement direction of a directional vibrator having a lowest strength of an output signal, among the plurality of directional vibrators, as the first direction of the first sound source or the second direction of the second sound source.

14. The sound source separation apparatus of claim 13, wherein the control circuit is further configured to compare a vibration strength of a directional vibrator arranged at +90° with respect to a directional vibrator having a lowest strength of an output signal with a vibration strength of a directional vibrator arranged at −90° with respect to the directional vibrator having the lowest strength of the output signal, and determine an arrangement direction of a directional vibrator having a higher strength of the output signal, among the directional vibrator arranged at +90° and the directional vibrator arranged at −90°, as the first direction of the first sound source or the second direction of the second sound source.

15. The sound source separation apparatus of claim 13, further comprising an omnidirectional vibrator configured to react to an input sound regardless of a direction of the input sound.

16. The sound source separation apparatus of claim 15, wherein the control circuit is further configured to compare a phase of a directional vibrator arranged at +90° with respect to a directional vibrator having a lowest strength of an output signal with a phase of the omnidirectional vibrator, compare a phase of a directional vibrator arranged at −90° with respect to the directional vibrator having the lowest strength of the output signal with the phase of the omnidirectional vibrator, and determine an arrangement direction of a directional vibrator, among the directional vibrator arranged at +90° and the directional vibrator arranged at −90°, having a phase closest to the phase of the omnidirectional vibrator as the direction of the first sound source or the second sound source.

17. The sound source separation apparatus of claim 15, wherein the plurality of directional vibrators and the omnidirectional vibrator are arranged on an identical plane, and the plurality of directional vibrators are arranged to surround the omnidirectional vibrator.

18. The sound source separation apparatus of claim 1, wherein the plurality of directional vibrators are arranged to have symmetry with respect to the center point.

19. The sound source separation apparatus of claim 1, wherein the sound outlet is provided to face all the plurality of directional vibrators.

20. The sound source separation apparatus of claim 1, wherein the sound outlet comprises a plurality of sound outlets respectively facing the plurality of directional vibrators.

21. The sound source separation apparatus of claim 1, wherein the plurality of directional vibrators have an identical resonant frequency.

22. The sound source separation apparatus of claim 1, wherein the plurality of directional vibrators comprise a plurality of directional vibrators having different resonant frequencies.

23. A sound source separation method comprising:

receiving a sound through a sound inlet of a sound source separation apparatus;

outputting the sound received through the sound inlet by a sound outlet;

determining a first direction of a first sound source and a second direction of a second sound source that is different from the first sound source, based on strengths of output signals of a plurality of directional vibrators arranged on a plane between the sound inlet and the sound outlet, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet;

selecting a first directional vibrator and a second directional vibrator from among the plurality of directional vibrators to separately obtain a first sound from the first sound source and a second sound from the second sound source; and obtaining sound information by using the first directional vibrator and the second directional vibrator, wherein the first directional vibrator is different from the second directional vibrator.

24. The sound source separation method of claim 23, wherein the determining of the first direction of the first sound source and the second direction of the second sound source comprises:

determining the second direction of the second sound source during a first time in which the first sound from the first sound source decreases; and determining the second direction of the first sound source during a second time in which the second sound coming from the second sound source decreases.

25. The sound source separation method of claim 24, wherein the determining of the first direction of the first sound source and the second direction of the second sound source comprises:

determining that there are two or more sound sources in a case that strengths of output signals of a plurality of directional vibrators arranged in a range of 180 degrees have two or more peaks; and determining a direction of a sound source during a time in which the strengths of the output signals of the plurality of directional vibrators arranged in the range of 180 degrees have one peak.

26. The sound source separation method of claim 23, wherein the determining of the first direction of the first sound source and the second direction of the second sound source comprises determining an arrangement direction of a directional vibrator having a highest strength of an output signal, among the plurality of directional vibrators, as the first direction of the first sound source or the second direction of the second sound source.

27. The sound source separation method of claim 23, wherein the determining of the first direction of the first sound source and the second direction of the second sound source comprises determining a direction perpendicular to an arrangement direction of a directional vibrator having a lowest strength of an output signal, among the plurality of directional vibrators, as the first direction of the first sound source or the second direction of the second sound source.

28. The sound source separation method of claim 27, wherein the determining of the first direction of the first sound source and the second direction of the second sound source comprises:

comparing a vibration strength of a directional vibrator arranged at +90° with respect to a directional vibrator having a lowest strength of an output signal with a vibration strength of a directional vibrator arranged at −90° with respect to the directional vibrator having the lowest strength of the output signal; and determining an arrangement direction of a directional vibrator having a higher strength of the output signal, among the directional vibrator arranged at +90° and the directional vibrator arranged at −90°, as the direction of the first sound source or the second sound source.

29. The sound source separation method of claim 27, further comprising receiving an input sound by using an omnidirectional vibrator reacting to the sound regardless of a direction of the input sound.

30. The sound source separation method of claim 29, wherein the determining of the first direction of the first sound source and the second direction of the second sound source comprises:

comparing a phase of a directional vibrator arranged at +90° with respect to a directional vibrator having a lowest strength of an output signal with a phase of the omnidirectional vibrator;

comparing a phase of a directional vibrator arranged at −90° with respect to the directional vibrator having the lowest strength of the output signal with a phase of the omnidirectional vibrator; and determining an arrangement direction of a directional vibrator having a phase closest to the phase of the omnidirectional vibrator, among the directional vibrator arranged at +90° and the directional vibrator arranged at −90°, as the first direction of the first sound source or the second direction of the second sound source.

31. The sound source separation method of claim 23, wherein the obtaining of the sound information by using the first directional vibrator and the second directional vibrator comprises:

obtaining first information about the first sound from the first sound source based on a first output signal of the first directional vibrator; and obtaining second information about the second sound from the second sound source based on a second output signal of the second directional vibrator.

32. The sound source separation method of claim 31, wherein the selecting of the first directional vibrator and the second directional vibrator comprises:

selecting a directional vibrator having a highest sensitivity to the first direction of the first sound source, among the plurality of directional vibrators, as the first directional vibrator; and selecting a directional vibrator having a highest sensitivity to the second direction of the second sound source, among the plurality of directional vibrators, as the second directional vibrator.

33. The sound source separation method of claim 31, wherein the selecting of the first directional vibrator and the second directional vibrator comprises:

selecting a directional vibrator arranged in the direction of the first sound source, among the plurality of directional vibrators, as the first directional vibrator; and selecting a directional vibrator arranged in the direction of the second sound source, among the plurality of directional vibrators, as the second directional vibrator.

34. The sound source separation method of claim 33, wherein the obtaining of the sound information by using the first directional vibrator and the second directional vibrator comprises:

determining a first rate of the second sound of the second sound source contributing to the first output signal of the first directional vibrator and a second rate of the first sound of the first sound source contributing to the second output signal of the second directional vibrator; and obtaining the first information about the first sound from the first sound source and the second information about the sound from the second sound source by computing the first output signal and the second output signal based on the first rate of the second sound of the second sound source contributing to the first output signal of the first directional vibrator and the second rate of the first sound of the first sound source contributing to the second signal of the second directional vibrator.

35. The sound source separation method of claim 34, wherein, in a case that the first output signal of the first directional vibrator is C1, the second output signal of the second directional vibrator is C2, a first sound signal of the first sound source is S1, a second sound signal of the second sound source is S2, the first rate of the second sound of the second sound source contributing to the first output signal of the first directional vibrator is a, and the second rate of the first sound of the first sound source contributing to the second output signal of the second directional vibrator is β, then $C1=S1+\alpha S2$ and $C2=S2+\beta S1$, and $S1=(C1-\alpha C2)/(1-\alpha\beta)$ and $S2=(C2-\beta C1)/(1-\alpha\beta)$.

36. The sound source separation method of claim 34, wherein the first rate of the second sound of the second sound source contributing to the first output signal of the first directional vibrator is determined by a first angle between the first directional vibrator and the second sound source, and the second rate of the first sound of the first sound source contributing to the second output signal of the second directional vibrator is determined by a second angle between the second directional vibrator and the first sound source.

37. The sound source separation method of claim 23, wherein the selecting of the first directional vibrator and the second directional vibrator comprises:

selecting a directional vibrator having a lowest sensitivity to the second direction of the second sound source, among a plurality of directional vibrators arranged in a first angle range around the first direction of the first sound source, as the first directional vibrator; and selecting a directional vibrator having a lowest sensitivity to the first direction of the first sound source, among the plurality of directional vibrators arranged in a second angle range around the second direction of the second sound source, as the second directional vibrator.

38. A sound source separation apparatus comprising:

a memory configured to store one or more instructions; and a processor configured to execute the one or more instructions to:

determine a first direction of a first sound source and a second direction of a second sound source that is different from the first sound source, based on strengths of output signals received from a plurality of directional vibrators arranged on a plane between a sound inlet and a sound outlet of the sound source separation apparatus, the plane being perpendicular to a central axis of the sound inlet, and the plurality of directional vibrators being arranged around a center point on the plane corresponding to the central axis of the sound inlet in such a manner that one or more of the plurality of directional vibrators is configured to selectively react based on a direction of the sound received through the sound inlet;

select a first directional vibrator and a second directional vibrator from among the plurality of directional vibrators to separately obtain a first sound from the first sound source and a second sound from the second sound source; and obtain sound information by using the first directional vibrator and the second directional vibrator, wherein the first directional vibrator is different from the second directional vibrator.

* * * * *